US009383688B2

(12) United States Patent
Hirai et al.

(10) Patent No.: US 9,383,688 B2
(45) Date of Patent: Jul. 5, 2016

(54) WET-TYPE DEVELOPING DEVICE AND WET-TYPE IMAGE FORMING APPARATUS WITH CHARGING UNIT AND NEUTRALIZING UNIT

(71) Applicant: KONICA MINOLTA, INC., Chiyoda-ku, Tokyo (JP)

(72) Inventors: Atsuto Hirai, Ikoma (JP); Takeshi Maeyama, Ikeda (JP); Junya Hirayama, Takarazuka (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/633,860

(22) Filed: Feb. 27, 2015

(65) Prior Publication Data

US 2015/0248080 A1 Sep. 3, 2015

(30) Foreign Application Priority Data

Mar. 3, 2014 (JP) ..... 2014-040312

(51) Int. Cl.
*G03G 15/11* (2006.01)
*G03G 21/00* (2006.01)

(52) U.S. Cl.
CPC ..... *G03G 15/11* (2013.01); *G03G 21/0088* (2013.01); *G03G 2215/0658* (2013.01)

(58) Field of Classification Search
CPC ..... G03G 21/0088; G03G 15/11
See application file for complete search history.

(56) References Cited

U.S. PATENT DOCUMENTS

| | | | | |
|---|---|---|---|---|
| 3,743,540 | A * | 7/1973 | Hudson | 134/1 |
| 5,956,548 | A * | 9/1999 | Hattori | 399/168 |
| 6,097,915 | A * | 8/2000 | Fleck et al. | 399/171 |
| 6,553,198 | B1 * | 4/2003 | Slattery et al. | 399/171 |
| 8,204,395 | B2 * | 6/2012 | Hirai | 399/57 |
| 2010/0040387 | A1 | 2/2010 | Hirai | |
| 2011/0249990 | A1 | 10/2011 | Izawa et al. | |
| 2012/0148279 | A1 | 6/2012 | Soda | |
| 2015/0078984 | A1 * | 3/2015 | Thielert | 423/574.1 |

FOREIGN PATENT DOCUMENTS

| | | |
|---|---|---|
| JP | 54-070055 A | 6/1979 |
| JP | 06-102783 A | 4/1994 |

(Continued)

OTHER PUBLICATIONS

Notice of Grounds of Rejection dated Mar. 1, 2016 issued in the corresponding Japanese Patent Application No. 2014-040312 and English translation (7 pages).

*Primary Examiner* — Clayton E LaBalle
*Assistant Examiner* — Leon W Rhodes, Jr.
(74) *Attorney, Agent, or Firm* — Buchanan Ingersoll & Rooney PC

(57) ABSTRACT

A wet-type developing device and a wet-type image forming apparatus each employ a developer including a carrier liquid and toner particles dispersed in the carrier liquid. A charging unit is applied with positive voltage. A neutralizing unit is applied with negative voltage. The charging unit and the neutralizing unit are made different from each other in one of a sectional configuration and a length to a developer carrier such that an absolute value of a voltage-current characteristic of the neutralizing unit becomes smaller than an absolute value of a voltage-current characteristic of the neutralizing unit including a constituent element equal to a constituent element of the charging unit.

20 Claims, 15 Drawing Sheets

(56) References Cited

FOREIGN PATENT DOCUMENTS

| | | | | |
|---|---|---|---|---|
| JP | 06-202441 | A | | 7/1994 |
| JP | 07043981 | A | * | 2/1995 |
| JP | 07-152225 | A | | 6/1995 |
| JP | 2010-044127 | A | | 2/2010 |
| JP | 2010-044189 | A | | 2/2010 |
| JP | 2011-197216 | A | | 10/2011 |
| JP | 2011-237514 | A | | 11/2011 |
| JP | 2012-068372 | A | | 4/2012 |
| JP | 2012-128094 | A | | 7/2012 |

* cited by examiner

FIG.7

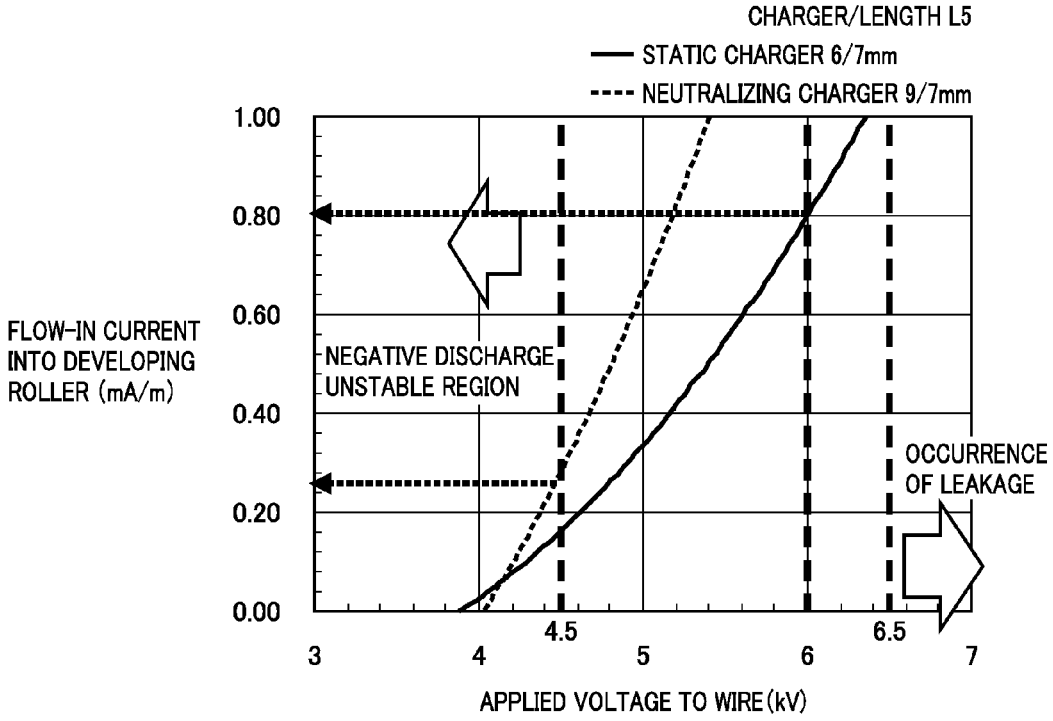

FIG.8

| FLOW-IN CURRENT FROM STATIC CHARGER 6 (mA/m) | 0.4 | 0.52 | 0.6 | 0.8 | 1 |
|---|---|---|---|---|---|
| APPROPRIATE FLOW-IN CURRENT FROM NEUTRALIZING CHARGER 9 (mA/m) | 0.2 | 0.26 | 0.3 | 0.4 | 0.5 |
| LEAKAGE (STATIC CHARGER 6) | A | A | A | A | F |
| LEAKAGE (NEUTRALIZING CHARGER 9) | A | A | A | A | A |
| UNEVEN NEUTRALIZATION | F | A | A | A | A |
| COMPATIBILITY BETWEEN STATIC CHARGE AND NEUTRALIZATION | F | A | A | A | F |

SETTABLE RANGE OF FLOW-IN CURRENT FROM STATIC CHARGER 6 0.52~0.8mA
SETTABLE WIDTH OF FLOW-IN CURRENT FROM STATIC CHARGER 6 0.28mA

FIG.9

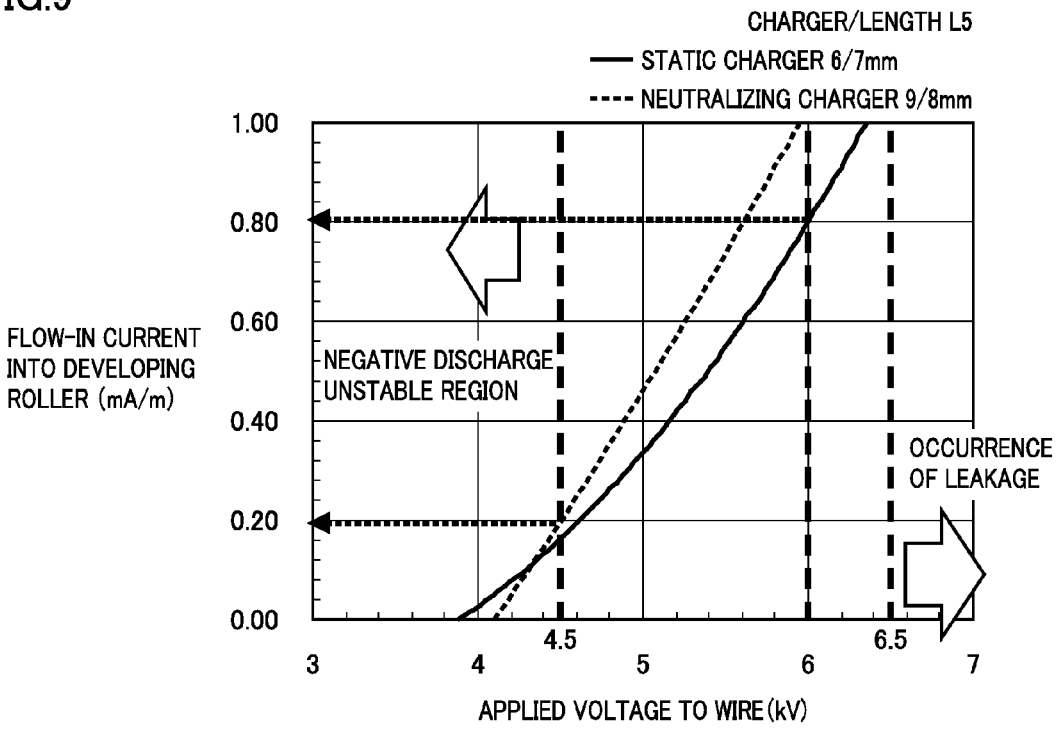

FIG.10

| FLOW-IN CURRENT FROM STATIC CHARGER 6 (mA/m) | 0.4 | 0.6 | 0.8 | 1 |
|---|---|---|---|---|
| APPROPRIATE FLOW-IN CURRENT FROM NEUTRALIZING CHARGER 9 (mA/m) | 0.2 | 0.3 | 0.4 | 0.5 |
| LEAKAGE (STATIC CHARGER 6) | A | A | A | F |
| LEAKAGE (NEUTRALIZING CHARGER 9) | A | A | A | A |
| UNEVEN NEUTRALIZATION | A | A | A | A |
| COMPATIBILITY BETWEEN STATIC CHARGE AND NEUTRALIZATION | A | A | A | F |

SETTABLE RANGE OF FLOW-IN CURRENT FROM STATIC CHARGER 6 0.4~0.8mA
SETTABLE WIDTH OF FLOW-IN CURRENT FROM STATIC CHARGER 6 0.4mA

FIG.11

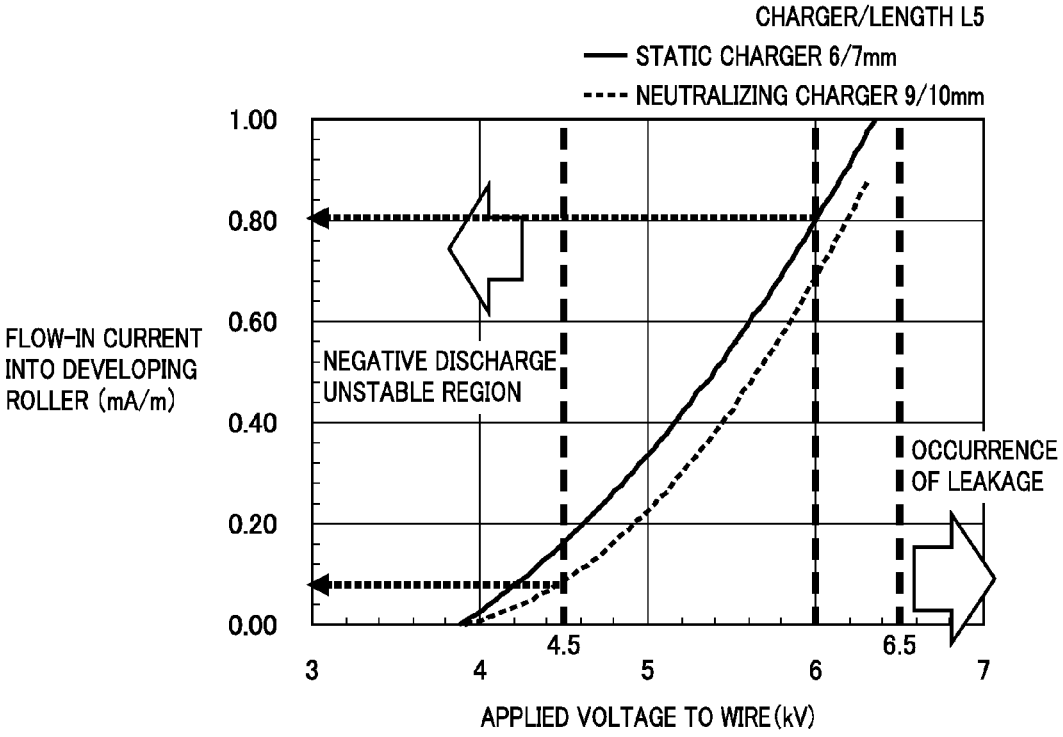

FIG.12

| FLOW-IN CURRENT FROM STATIC CHARGER 6 (mA/m) | 0.16 | 0.4 | 0.6 | 0.8 | 1 |
|---|---|---|---|---|---|
| APPROPRIATE FLOW-IN CURRENT FROM NEUTRALIZING CHARGER 9 (mA/m) | 0.08 | 0.2 | 0.3 | 0.4 | 0.5 |
| LEAKAGE (STATIC CHARGER 6) | A | A | A | A | F |
| LEAKAGE (NEUTRALIZING CHARGER 9) | A | A | A | A | A |
| UNEVEN NEUTRALIZATION | A | A | A | A | A |
| COMPATIBILITY BETWEEN STATIC CHARGE AND NEUTRALIZATION | A | A | A | A | F |

SETTABLE RANGE OF FLOW-IN CURRENT FROM STATIC CHARGER 6 0.16~0.8mA
SETTABLE WIDTH OF FLOW-IN CURRENT FROM STATIC CHARGER 6 0.64mA

FIG.13

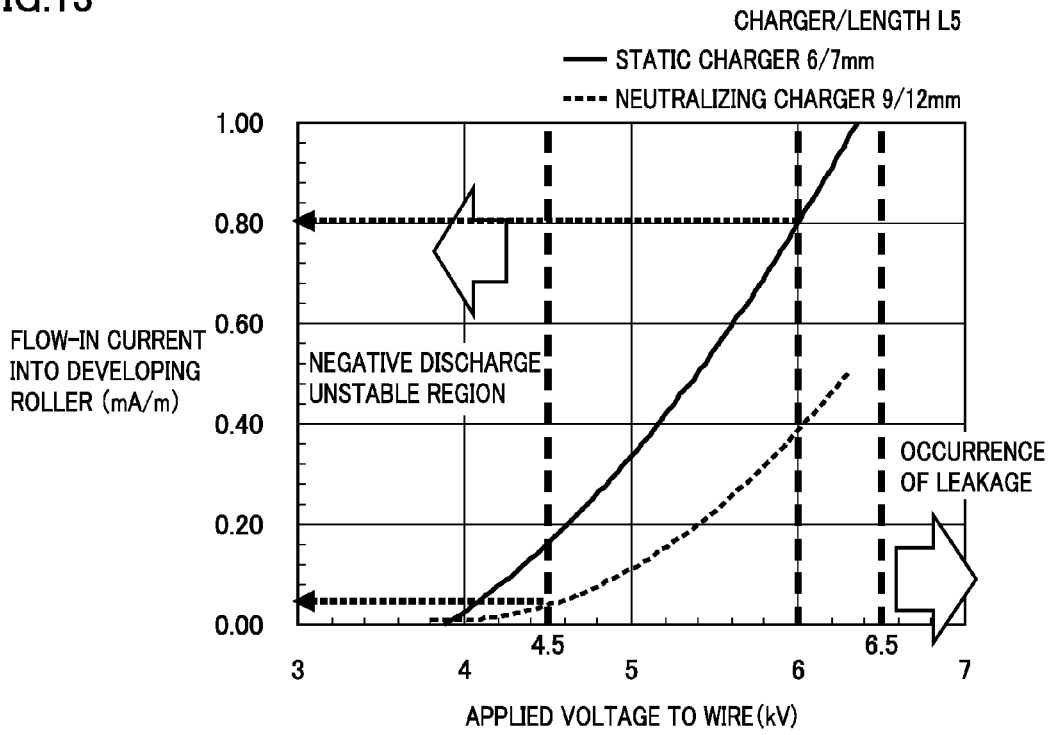

FIG.14

| FLOW-IN CURRENT FROM STATIC CHARGER 6 (mA/m) | 0.04 | 0.4 | 0.6 | 0.8 | 1 |
|---|---|---|---|---|---|
| APPROPRIATE FLOW-IN CURRENT FROM NEUTRALIZING CHARGER 9 (mA/m) | 0.02 | 0.2 | 0.3 | 0.4 | 0.5 |
| LEAKAGE (STATIC CHARGER 6) | A | A | A | A | F |
| LEAKAGE (NEUTRALIZING CHARGER 9) | A | A | A | A | A |
| UNEVEN NEUTRALIZATION | A | A | A | A | A |
| COMPATIBILITY BETWEEN STATIC CHARGE AND NEUTRALIZATION | A | A | A | A | F |

SETTABLE RANGE OF FLOW-IN CURRENT FROM STATIC CHARGER 6 0.04~0.8mA
SETTABLE WIDTH OF FLOW-IN CURRENT FROM STATIC CHARGER 6 0.76mA

FIG.15

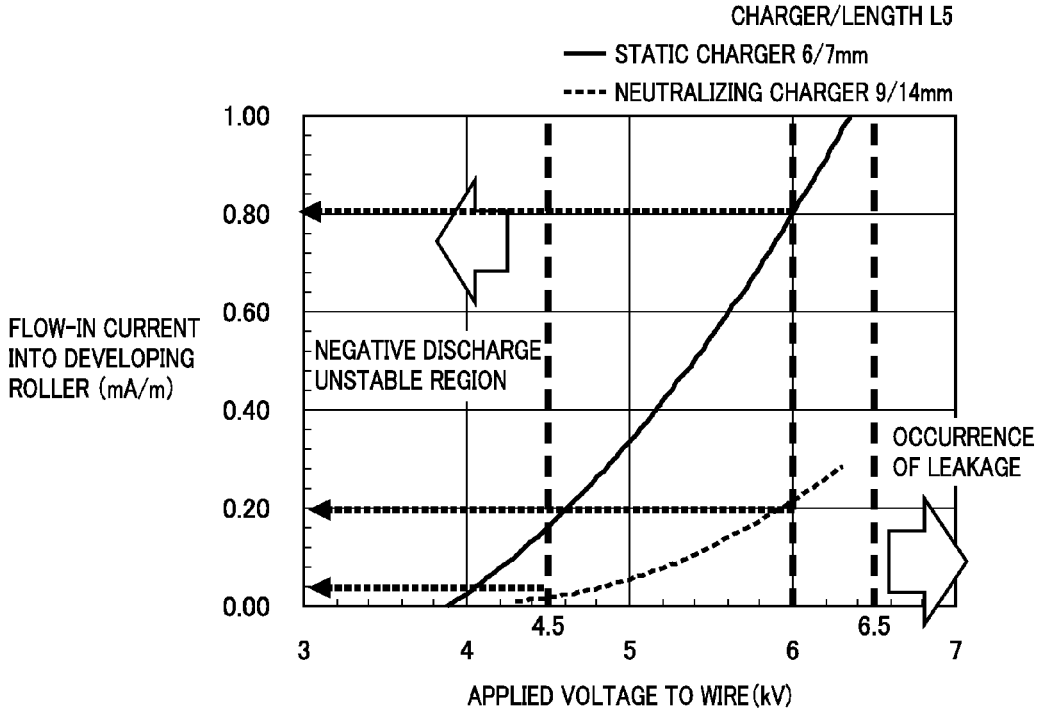

FIG.16

| FLOW-IN CURRENT FROM STATIC CHARGER 6 (mA/m) | 0.04 | 0.4 | 0.6 | 0.8 | 1 |
|---|---|---|---|---|---|
| APPROPRIATE FLOW-IN CURRENT FROM NEUTRALIZING CHARGER 9 (mA/m) | 0.02 | 0.2 | 0.3 | 0.4 | 0.5 |
| LEAKAGE (STATIC CHARGER 6) | A | A | A | A | F |
| LEAKAGE (NEUTRALIZING CHARGER 9) | A | A | F | F | F |
| UNEVEN NEUTRALIZATION | A | A | A | A | A |
| COMPATIBILITY BETWEEN STATIC CHARGE AND NEUTRALIZATION | A | A | F | F | F |

SETTABLE RANGE OF FLOW-IN CURRENT FROM STATIC CHARGER 6 0.04~0.4mA
SETTABLE WIDTH OF FLOW-IN CURRENT FROM STATIC CHARGER 6 0.36mA

FIG.17

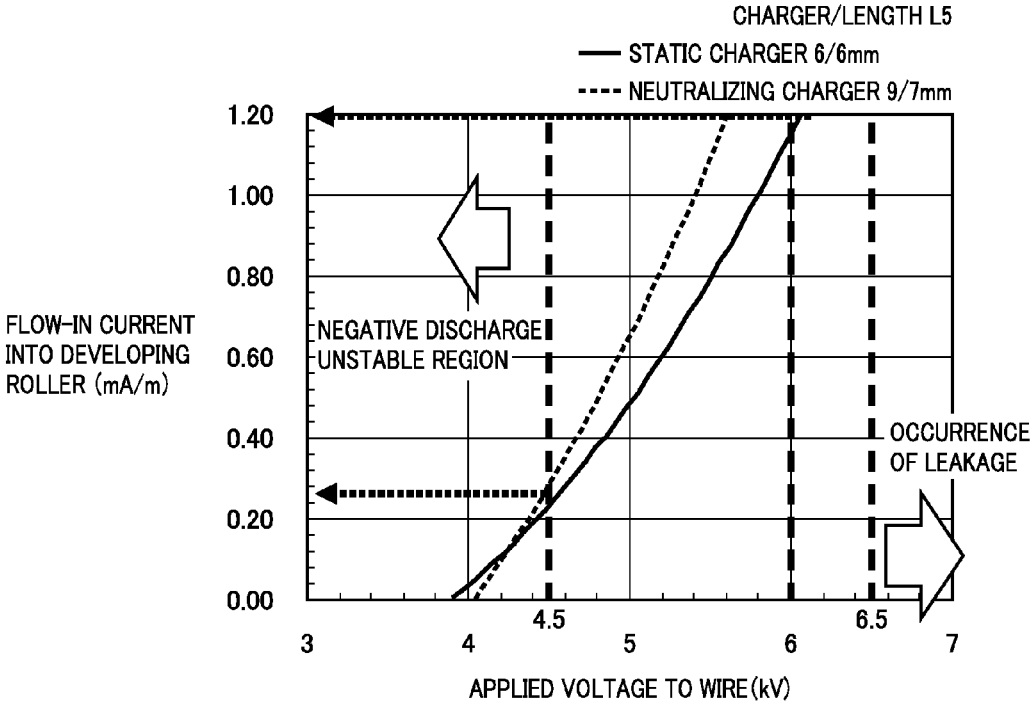

FIG.18

| FLOW-IN CURRENT FROM STATIC CHARGER 6 (mA/m) | 0.4 | 0.52 | 0.6 | 0.8 | 1 | 1.2 |
|---|---|---|---|---|---|---|
| APPROPRIATE FLOW-IN CURRENT FROM NEUTRALIZING CHARGER 9 (mA/m) | 0.2 | 0.26 | 0.3 | 0.4 | 0.5 | 0.6 |
| LEAKAGE (STATIC CHARGER 6) | A | A | A | A | A | A |
| LEAKAGE (NEUTRALIZING CHARGER 9) | A | A | A | A | A | A |
| UNEVEN NEUTRALIZATION | F | A | A | A | A | A |
| COMPATIBILITY BETWEEN STATIC CHARGE AND NEUTRALIZATION | F | A | A | A | A | A |

SETTABLE RANGE OF FLOW-IN CURRENT FROM STATIC CHARGER 6 0.52~1.2mA
SETTABLE WIDTH OF FLOW-IN CURRENT FROM STATIC CHARGER 6 0.68mA

FIG.19

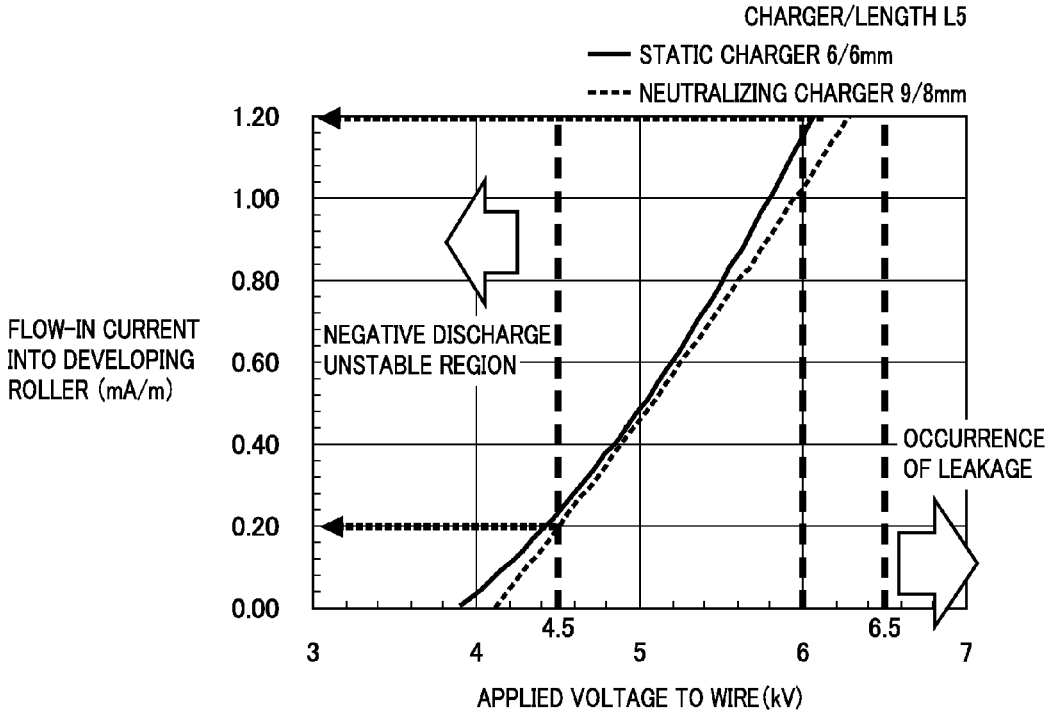

FIG.20

| FLOW-IN CURRENT FROM STATIC CHARGER 6 (mA/m) | 0.4 | 0.6 | 0.8 | 1 | 1.2 |
|---|---|---|---|---|---|
| APPROPRIATE FLOW-IN CURRENT FROM NEUTRALIZING CHARGER 9 (mA/m) | 0.2 | 0.3 | 0.4 | 0.5 | 0.6 |
| LEAKAGE (STATIC CHARGER 6) | A | A | A | A | A |
| LEAKAGE (NEUTRALIZING CHARGER 9) | A | A | A | A | A |
| UNEVEN NEUTRALIZATION | A | A | A | A | A |
| COMPATIBILITY BETWEEN STATIC CHARGE AND NEUTRALIZATION | A | A | A | A | A |

SETTABLE RANGE OF FLOW-IN CURRENT FROM STATIC CHARGER 6 0.04～1.2mA
SETTABLE WIDTH OF FLOW-IN CURRENT FROM STATIC CHARGER 6 0.8mA

FIG.21

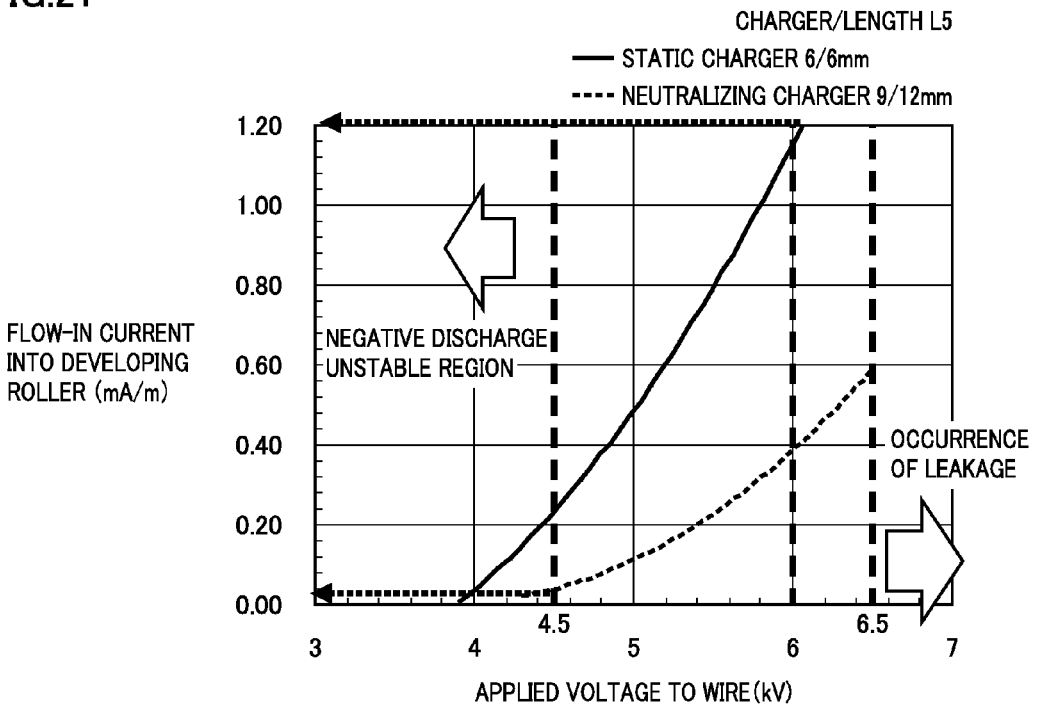

FIG.22

| FLOW-IN CURRENT FROM STATIC CHARGER 6 (mA/m) | 0.04 | 0.4 | 0.6 | 0.8 | 1 | 1.2 |
|---|---|---|---|---|---|---|
| APPROPRIATE FLOW-IN CURRENT FROM NEUTRALIZING CHARGER 9 (mA/m) | 0.02 | 0.2 | 0.3 | 0.4 | 0.5 | 0.6 |
| LEAKAGE (STATIC CHARGER 6) | A | A | A | A | A | A |
| LEAKAGE (NEUTRALIZING CHARGER 9) | A | A | A | A | F | F |
| UNEVEN NEUTRALIZATION | A | A | A | A | A | A |
| COMPATIBILITY BETWEEN STATIC CHARGE AND NEUTRALIZATION | A | A | A | A | F | F |

SETTABLE RANGE OF FLOW-IN CURRENT FROM STATIC CHARGER 6 0.04~0.8mA
SETTABLE WIDTH OF FLOW-IN CURRENT FROM STATIC CHARGER 6 0.76mA

WET-TYPE DEVELOPING DEVICE AND WET-TYPE IMAGE FORMING APPARATUS WITH CHARGING UNIT AND NEUTRALIZING UNIT

This application is based on Japanese Patent Application No. 2014-040312 filed with the Japan Patent Office on Mar. 3, 2014, the entire content of which is hereby incorporated by reference.

BACKGROUND OF THE INVENTION

1. Field of the Invention

The present invention relates to printers, copiers, facsimile machines, and other electrophotographic image forming apparatuses. More particularly, the present invention relates to a wet-type developing device and a wet-type image forming apparatus that employ wet-type development as a developing method.

2. Description of the Related Art

Various wet-type image forming apparatuses have been proposed, and such a conventional wet-type image forming apparatus employs wet-type electrophotography that allows high-quality image output using toner with a small diameter, as compared with dry-type electrophotography. Japanese Laid-Open Patent Publication No. 2012-128094, Japanese Laid-Open Patent Publication No. 2012-068372, and Japanese Laid-Open Patent Publication No. 2011-197216 disclose wet-type developing devices and wet-type image forming apparatuses that employ wet-type electrophotography.

In a case of developing charged toner particles on a developing roller, and then cleaning the charged toner from the developing roller using a cleaning blade, the cleaning process tends to end in failure due to high adhesion of the toner particles to the developing roller.

In order to facilitate the cleaning process, a neutralizing charger is disposed on the upstream side of the cleaning blade. The neutralizing charger applies electric charge which is opposite in polarity to the electric charge applied to the toner particles, to the toner on the developing roller, thereby lowering the charged level of the toner.

The electric charge applied to the toner particles by a static charger decays with a lapse of time. Therefore, flow-in current from the static charger and flow-in current from the neutralizing charger are appropriately set such that the flow-in current from the static charger becomes larger in absolute value than the flow-in current from the neutralizing charger.

A corotron charger has a polarity-dependent discharge characteristic (an amount of discharged current relative to applied voltage to a wire), and tends to be discharged in a case of negative polarity rather than positive polarity. As a result, an absolute value of flow-in current into a developing roller relative to an absolute value of applied voltage to a wire (a V-I characteristic) is large in the case of negative polarity rather than positive polarity.

In a case of using a photoconductor made of a-Si, preferably, toner particles are positively charged. Typically, a static charger (positive discharge) required to be applied with high voltage has a low V-I characteristic whereas a neutralizing charger (negative discharge) required to be applied with low voltage has a high V-I characteristic.

Applied voltage to a wire of a charger has an upper limit determined from a critical limit of leakage initiation, and a lower limit determined from discharge initiation voltage. Negative polarity causes a region where discharge is unstable even after the start of discharge, which results in uneven discharge. Therefore, the applied voltage to the wire is set to be higher than the discharge initiation voltage in order that the charger is used in a region where the discharge is stable. The uneven discharge refers to such a phenomenon that a charger has a discharge stable area and a discharge unstable area depending on a location of a wire.

Leakage from a static charger causes uneven static charge on a toner layer, and the uneven static charge appears as noise on an image. On the other hand, uneven discharge by a neutralizing charger causes failed toner neutralization depending on a place. Consequently, cleaning ends in failure at the place, and the failed cleaning appears as a streak.

Applied voltage to a wire has an upper limit and a lower limit as described above. When a static charger and a neutralizing charger are corotron chargers which are similar in sectional configuration to each other as before, applied voltage to a wire of the static charger tends to exceed the upper limit (critical limit of leakage initiation) because the static charger has a large amount of required electric charge and a low discharge characteristic. On the other hand, applied voltage to a wire of the neutralizing charger tends to fall short of the lower limit (critical limit of negative uneven discharge) because the neutralizing charger has a small amount of required electric charge and a high discharge characteristic. Moreover, the upper and lower limits of the applied voltage restrict a usable range of flow-in current.

The static charger and the neutralizing charger may be used such that flow-in current into a developing roller falls within the range set by the upper and lower limits. However, the required flow-in current is determined from, for example, a charged level of toner, an amount of toner (based on a kind of a sheet of paper), and an external environment. In actual fact, therefore, an adjustable width of the flow-in current is required to be widely secured. Desirably, the adjustable width can be widely secured as much as possible.

A toner dispersing member (such as an AC roller) may be disposed on the upstream side of a cleaning member in order to improve cleaning performance. In such a case, however, if a neutralizing charger is unevenly discharged because applied voltage to a wire is low, cleaning ends in failure at part of a cleaning portion. Further, a developer is deposited on part of the cleaning portion.

SUMMARY OF THE INVENTION

An object of the present invention is to provide a wet-type developing device and a wet-type image forming apparatus, and the wet-type developing device has the configuration and charging polarity described above, and is capable of extending a settable range of flow-in current into a developing roller while suppressing generation of noise on an image due to leakage from a static charger and occurrence of failed cleaning at a cleaning portion.

A wet-type developing device according to one aspect employs a developer that includes a carrier liquid and a toner particle dispersed in the carrier liquid, and includes a developer carrier, a charging unit, a neutralizing unit, and a cleaning member. The developer carrier is configured to develop an electrostatic latent image. The charging unit is configured to charge the developer on the developer carrier by discharge. The neutralizing unit is configured to neutralize the electric charge of the developer after the development by discharge which is equal in manner to the discharge by the charging unit. The cleaning member is configured to remove the developer after the neutralization from the developer carrier. In the wet-type developing device, the charging unit is applied with positive voltage. The neutralizing unit is applied with negative voltage. The charging unit and the neutralizing unit are made different from each other in one of a sectional configuration and a length to the developer carrier such that an absolute value of a voltage-current characteristic of the neutralizing unit becomes smaller than an absolute value of a voltage-current characteristic of the neutralizing unit including a constituent element equal to a constituent element of the charging unit.

A wet-type developing device according to another aspect employs a developer that includes a carrier liquid and a toner particle dispersed in the carrier liquid, and includes a developer carrier, a charging unit, a neutralizing unit, and a cleaning member. The developer carrier is configured to develop an electrostatic latent image. The charging unit is configured to charge the developer on the developer carrier by discharge. The neutralizing unit is configured to neutralize the electric charge of the developer after the development by discharge which is equal in manner to the discharge by the charging unit. The cleaning member is configured to remove the developer after the neutralization from the developer carrier. In the wet-type developing device, the charging unit is applied with positive voltage. The neutralizing unit is applied with negative voltage. The charging unit and the neutralizing unit are made different from each other in one of a sectional configuration and a length to the developer carrier such that, with regard to voltage-current characteristics of the charging unit and neutralizing unit, an absolute value of current from neutralizing unit becomes smaller than an absolute value of current from the charging unit in a case where applied voltage to the charging unit is equal to applied voltage to the neutralizing unit.

A wet-type developing device according to still another aspect employs a developer that includes a carrier liquid and a toner particle dispersed in the carrier liquid, and includes a developer carrier, a charging unit, a neutralizing unit, and a cleaning member. The developer carrier is configured to develop an electrostatic latent image. The charging unit is configured to charge the developer on the developer carrier. The neutralizing unit is configured to neutralize the electric charge of the developer after the development. The cleaning member is configured to remove the developer after the neutralization from the developer carrier.

In the wet-type developing device, the charging unit is formed of a corotron charger. The neutralizing unit is formed of a corotron charger. The charging unit is applied with positive voltage. The neutralizing unit is applied with negative voltage. The charging unit and the neutralizing unit are made different from each other in one of a sectional configuration of the corotron charger and a length to the developer carrier such that an absolute value of a voltage-current characteristic of the neutralizing unit becomes smaller than an absolute value of a voltage-current characteristic of the neutralizing unit including a constituent element equal to a constituent element of the charging unit.

A wet-type developing device according to yet another aspect employs a developer that includes a carrier liquid and a toner particle dispersed in the carrier liquid, and includes a developer carrier, a charging unit, a neutralizing unit, and a cleaning member. The developer carrier is configured to develop an electrostatic latent image. The charging unit is configured to charge the developer on the developer carrier. The neutralizing unit is configured to neutralize the electric charge of the developer after the development. The cleaning member is configured to remove the developer after the neutralization from the developer carrier.

In the wet-type developing device, the charging unit is formed of a corotron charger. The neutralizing unit is formed of a corotron charger. The charging unit is applied with positive voltage. The neutralizing unit is applied with negative voltage. The charging unit and the neutralizing unit are made different from each other in a sectional configuration of the corotron charger such that, with regard to voltage-current characteristics of the corotron chargers, an absolute value of current from the neutralizing unit becomes smaller than an absolute value of current from the charging unit in a case where applied voltage to the charging unit is equal to applied voltage to the neutralizing unit.

According to one exemplary embodiment, the charging unit and the neutralizing unit are made different from each other in one of the sectional configuration of the corotron charger and the length to the developer carrier such that, with regard to the voltage-current characteristics of the corotron chargers, the absolute value of the current from the neutralizing unit becomes not less than about a half of the absolute value of the current from the charging unit in the case where the applied voltage to the charging unit is equal to the applied voltage to the neutralizing unit.

According to another exemplary embodiment, each of the corotron chargers includes, as the constituent element, a wire and a casing configured to cover the wire. A length from the wire of the neutralizing unit to the developer carrier is longer than a length from the wire of the charging unit to the developer carrier.

According to still another exemplary embodiment, each of the corotron chargers includes a wire and a casing configured to cover the wire. A length from the casing of the charging unit to the developer carrier is longer than a length from the casing of the neutralizing unit to the developer carrier.

According to yet another embodiment, each of the corotron chargers includes a wire and a casing configured to cover the wire. A length of a portion between the wire and the casing which are in closest proximity to each other in the charging unit is longer than a length of a portion between the wire and the casing which are in closest proximity to each other in the neutralizing unit.

According to yet another embodiment, each of the corotron chargers includes a wire and a casing configured to cover the wire. The number of wires in the charging unit is larger than the number of wires in the neutralizing unit.

According to yet another embodiment, the wet-type developing device further includes a toner particle dispersing member disposed on a downstream side of the neutralizing unit and an upstream side of the cleaning member in a direction of rotation of the developer carrier so as to face the developer carrier.

According to yet another embodiment, the toner particle dispersing member is in contact with the developer carrier, and applies AC bias to the developer carrier.

A wet-type image forming apparatus according to the present invention includes an image carrier, an image forming mechanism configured to form an electrostatic latent image on the image carrier, and the foregoing wet-type developing device configured to develop the electrostatic latent image formed on the image carrier by the image forming mechanism.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7 illustrates a voltage-current characteristic indicating a relation between applied voltage to a wire and flow-in current into a developing roller in a case where a static charger and a neutralizing charger are equal in constituent elements to each other, a length from the wire of the static charger to the developing roller is 7 mm, and a length from the wire of the neutralizing charger to the developing roller is also 7 mm, in a second embodiment.

FIG. 8 illustrates an allowable width within which flow-in current from the static charger can be set, in the case illustrated in FIG. 7.

FIG. 9 illustrates a voltage-current characteristic indicating a relation between the applied voltage to the wire and the flow-in current into the developing roller in a case where the length from the wire of the static charger to the developing roller is 7 mm, and the length from the wire of the neutralizing charger to the developing roller is 8 mm, in the second embodiment.

FIG. 10 illustrates an allowable width within which the flow-in current from the static charger can be set, in the case illustrated in FIG. 9.

FIG. 11 illustrates a voltage-current characteristic indicating a relation between the applied voltage to the wire and the flow-in current into the developing roller in a case where the length from the wire of the static charger to the developing roller is 7 mm, and the length from the wire of the neutralizing charger to the developing roller is 10 mm, in the second embodiment.

FIG. 12 illustrates an allowable width within which the flow-in current from the static charger can be set, in the case illustrated in FIG. 11.

FIG. 13 illustrates a voltage-current characteristic indicating a relation between the applied voltage to the wire and the flow-in current into the developing roller in a case where the length from the wire of the static charger to the developing roller is 7 mm, and the length from the wire of the neutralizing charger to the developing roller is 12 mm, in the second embodiment.

FIG. 14 illustrates an allowable width within which the flow-in current from the static charger can be set, in the case illustrated in FIG. 13.

FIG. 15 illustrates a voltage-current characteristic indicating a relation between the applied voltage to the wire and the flow-in current into the developing roller in a case where the length from the wire of the static charger to the developing roller is 7 mm, and the length from the wire of the neutralizing charger to the developing roller is 14 mm, in the second embodiment.

FIG. 16 illustrates an allowable width within which the flow-in current from the static charger can be set, in the case illustrated in FIG. 15.

FIG. 17 illustrates a voltage-current characteristic indicating a relation between the applied voltage to the wire and the flow-in current into the developing roller in a case where the length from the wire of the static charger to the developing roller is 6 mm, and the length from the wire of the neutralizing charger to the developing roller is 7 mm, in the second embodiment.

FIG. 18 illustrates an allowable width within which the flow-in current from the static charger can be set, in the case illustrated in FIG. 17.

FIG. 19 illustrates a voltage-current characteristic indicating a relation between the applied voltage to the wire and the flow-in current into the developing roller in a case where the length from the wire of the static charger to the developing roller is 6 mm, and the length from the wire of the neutralizing charger to the developing roller is 8 mm, in the second embodiment.

FIG. 20 illustrates an allowable width within which the flow-in current from the static charger can be set, in the case illustrated in FIG. 19.

FIG. 21 illustrates a voltage-current characteristic indicating a relation between the applied voltage to the wire and the flow-in current into the developing roller in a case where the length from the wire of the static charger to the developing roller is 6 mm, and the length from the wire of the neutralizing charger to the developing roller is 12 mm, in the second embodiment.

FIG. 22 illustrates an allowable width within which the flow-in current from the static charger can be set, in the case illustrated in FIG. 21.

DESCRIPTION OF THE PREFERRED EMBODIMENTS

With reference to the drawings, hereinafter, description will be given of a wet-type developing device and a wet-type image forming apparatus in embodiments of the present invention. The description in each of the embodiments shows a number, an amount, and the like; however, such a number, an amount, and the like do not necessarily intend to limit the scope of the present invention unless otherwise specified. Moreover, identical components or equivalent components are denoted with identical reference signs; therefore, the repeated description thereof will not be given as necessary.

The following description shows an absolute value of applied voltage to a neutralizing charger and an absolute value of flow-in current into a developing roller.

(First Embodiment)

Figure 1:
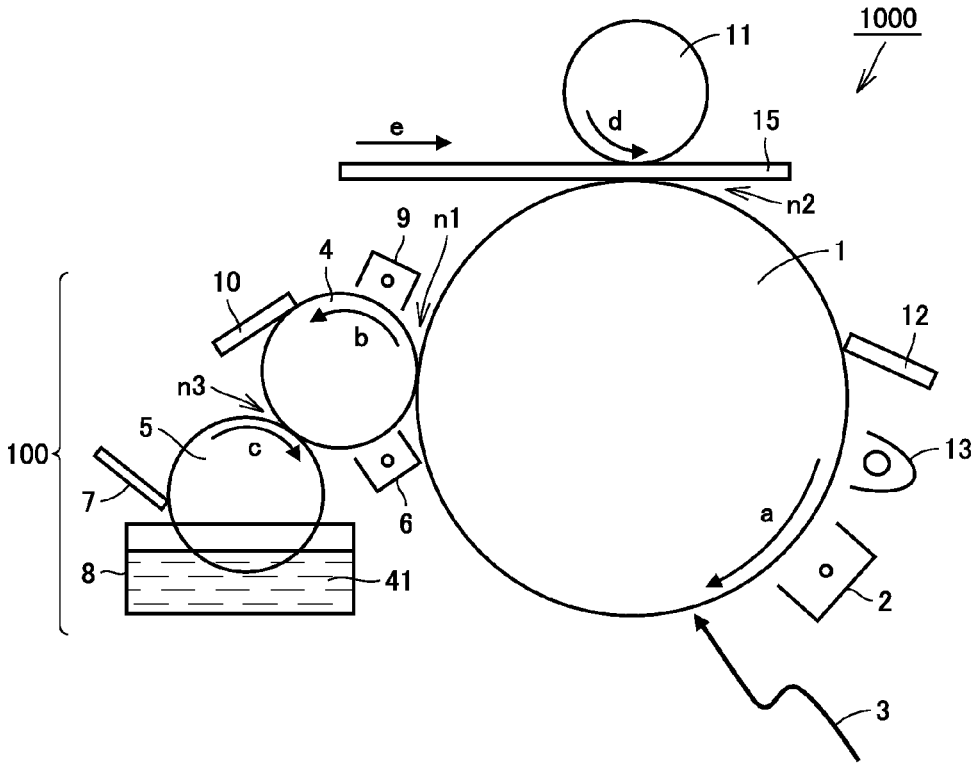
FIG. 1 schematically illustrates a configuration of a wet-type developing device and a configuration of a wet-type image forming apparatus, in a first embodiment.

With reference to FIG. 1, description will be given of a wet-type developing device 100 and a wet-type image forming apparatus 1000 that employ a liquid developer, in a first embodiment. FIG. 1 schematically illustrates a configuration of wet-type developing device 100 and a configuration of wet-type image forming apparatus 1000, in the first embodiment.

Wet-type image forming apparatus 1000 includes a photoconductor 1. Wet-type image forming apparatus 1000 also includes wet-type developing device 100, a transfer roller 11, a cleaning unit 12, an eraser lamp 13, a charging device 2, and an exposure device 3 each disposed near photoconductor 1 as illustrated in FIG. 1.

Wet-type developing device 100 includes a developer reservoir 8, a supply roller 5, and a developing roller 4. Developer reservoir 8 stores therein a liquid developer 41. Supply roller 5 rotates in the direction of an arrow c in FIG. 1. Wet-type developing device 100 also includes a regulating blade 7 disposed near supply roller 5. Developing roller 4 rotates in the direction of an arrow b in FIG. 1. Wet-type developing device 100 also includes a static charger 6, a neutralizing charger 9, and a cleaning blade 10 each disposed near developing roller 4.

Photoconductor 1 rotates in the direction of an arrow a in FIG. 1. Photoconductor 1 is uniformly charged at a certain potential by charging device 2, and then is exposed by exposure device 3. As the result of exposure, the potential at an image portion decays, so that an electrostatic latent image is formed. Photoconductor 1 having the electrostatic latent image formed thereon is conveyed to a development portion (nip portion) n1 facing developing roller 4. Developing roller 4 rotates in the direction of arrow b in FIG. 1. At development portion n1, liquid developer 41 on developing roller 4 comes into contact with photoconductor 1. Liquid developer 41 includes toner particles made of a colorant and a resin, and a carrier liquid (dispersion medium) for dispersing the toner particles.

The toner particles on developing roller 4 are charged. The toner particles on a print portion of photoconductor 1 adhere to photoconductor 1 whereas the toner particles on a background portion of photoconductor 1 adhere to developing roller 4. The toner particles developed on photoconductor 1 are conveyed to a transfer portion n2 facing transfer roller 11. At transfer portion n2, a transfer target (sheet of paper) 15 is fed in the direction of an arrow e in FIG. 1. The toner particles on photoconductor 1 are transferred to transfer target 15 based on voltage which is applied to transfer roller 11 and is opposite in polarity to the electric charge applied to the toner particles. Transfer target 15 having the toner particles transferred thereto is fed to a fixing portion (not illustrated) at which a toner image is fixed.

After the transferring process, cleaning unit 12 recovers the toner particles and carrier liquid left on photoconductor 1 passing transfer portion n2. Eraser lamp 13 exposes photoconductor 1 from which the toner particles and carrier liquid are removed, to light, thereby canceling a latent image potential. Cleaning blade 10 removes the toner particles and carrier liquid left on developing roller 4 passing development portion (nip portion) n1. Repetition of these processes allows successive image printing on transfer target 15.

(Wet-Type Developing Device 100)

Next, detailed description will be given of wet-type developing device 100. Developer reservoir 8 stores therein liquid developer 41 that includes the toner particles made of the colorant and the resin, and the carrier liquid (dispersion medium) for dispersing the toner particles. Supply roller 5 is partially immersed in liquid developer 41 and rotates in the direction of arrow c in FIG. 1. The rotation of supply roller 5 allows liquid developer 41 to be drawn up, and regulating blade 7 disposed in contact with supply roller 5 smoothes the thickness of liquid developer 41.

Liquid developer 41 having the thickness smoothed on supply roller 5 is conveyed to nip portion n3 between supply roller 5 and developing roller 4, and then is transferred onto developing roller 4. Liquid developer 41 transferred to developing roller 4 is conveyed to a portion facing static charger 6 by the rotation of developing roller 4 (in the direction of arrow b in FIG. 1). The toner particles in liquid developer 41 are charged by flow-in current from static charger 6 into developing roller 4. Thereafter, charged liquid developer 41 is conveyed to development portion (nip portion) n1 between developing roller 4 and photoconductor 1, so that the electrostatic latent image on photoconductor 1 is developed.

Liquid developer 41 which is not used for the development and is left on developing roller 4 is conveyed to a portion facing neutralizing charger 9. Neutralizing charger 9 is applied with voltage which is opposite in polarity to voltage applied to static charger 6. The toner particles on developing roller 4 are applied with electric charge with reverse polarity by flow-in current from neutralizing charger 9 into developing roller 4. In this state, cleaning blade 10 recovers the toner particles. This configuration improves cleaning performance because the charged level of the toner is lowered before cleaning blade 10 recovers the toner.

Liquid developer 41 recovered by cleaning blade 10 is different in toner particle concentration from liquid developer 41 stored in developer reservoir 8. Therefore, liquid developer 41 recovered by cleaning blade 10 is stored in a different tank (not illustrated) from developer reservoir 8. The toner particle concentration of liquid developer 41 is adjusted in this tank. Thereafter, liquid developer 41 is returned to developer reservoir 8 again.

Examples of supply roller 5 may include a rubber roller made of urethane or NBR (Nitril-Butadiene Rubber), and an anilox roller having a surface on which a recess is formed. Examples of developing roller 4 may include a rubber roller made of urethane or NBR.

Figure 2:
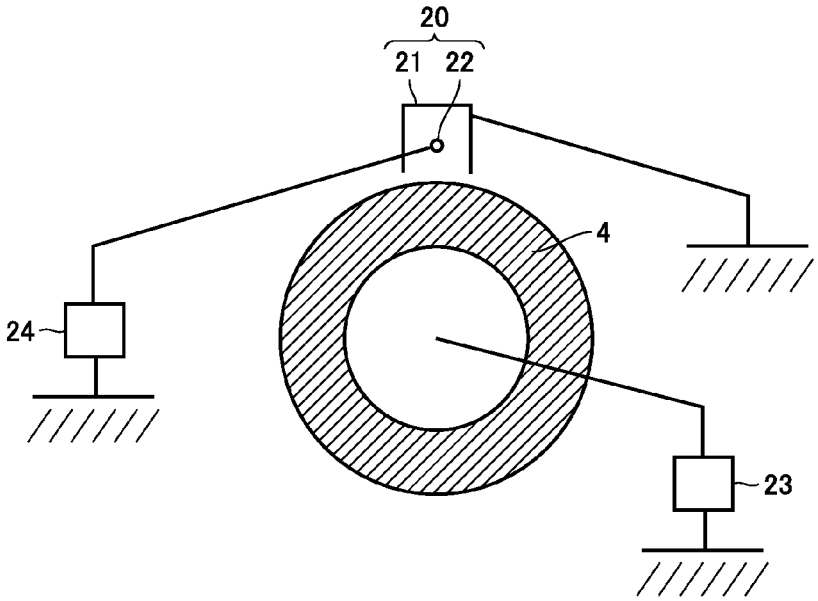
FIG. 2 schematically illustrates a relation between a developing roller and a corotron charger, in the first embodiment.

With reference to FIG. 2, next, description will be given of a method of measuring flow-in current from a corotron charger serving as static charger 6 (or neutralizing charger 9) into developing roller 4 (voltage-current characteristic: V-I characteristic). FIG. 2 schematically illustrates a relation between developing roller 4 and corotron charger (charger) 20.

Corotron charger 20 includes a wire 22 that extends in parallel with the direction of a rotational axis of developing roller 4, and a conductive casing 21 that extends in the same direction as that of wire 22 and covers wire 22. Casing 21 has an open end facing developing roller 4. In the first embodiment, casing 21 has a substantially rectangular (gate-like) sectional shape in a plane which is orthogonal to wire 22.

In corotron charger 20, wire 22 is connected to a high-voltage power supply 24, and casing 21 is connected to a ground. Wire 22 used herein was a gold-plated tungsten wire with a diameter of 90 μm. Developing roller 4 is connected to the ground via an ammeter 23. The flow-in current into developing roller 4 was measured in a state in which developing roller 4 is stopped.

The high-voltage power supply used herein was Model 610E available from TREK Inc., and the ammeter used herein was 3257 DIGITAL HiTESTER available from HIOKI E. E. CORPORATION. Developing roller 4 used herein was a rubber roller including a core 4*a* with a diameter of 20 mm and conductive polyurethane rubber 4*b* with a thickness of 10 mm.

Figure 3:
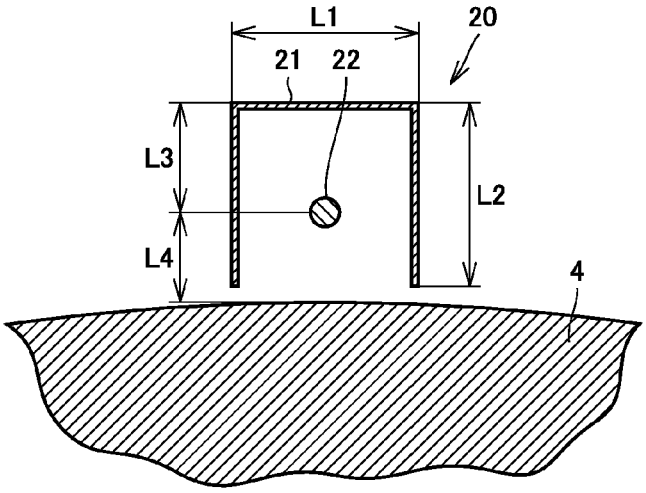
FIG. 3 illustrates a sectional structure of the corotron charger, in the first embodiment.
Figure 4:
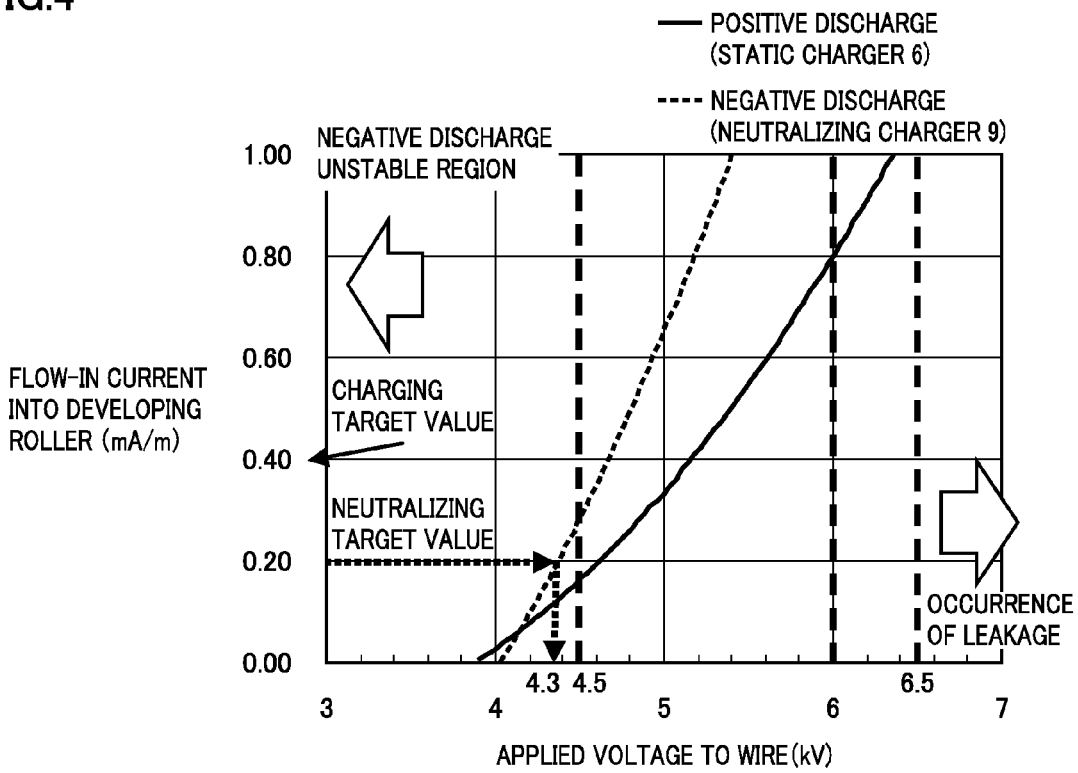
FIG. 4 illustrates a voltage-current characteristic indicating a relation between applied voltage to a wire of the corotron charger and flow-in current from the corotron charger into the developing roller, in the first embodiment.

FIG. 3 illustrates a sectional structure of corotron charger 20. FIG. 4 illustrates a voltage-current characteristic indicating a relation between the applied voltage to the wire of the corotron charger (static charger 6 (positive discharge), neutralizing charger 9 (negative discharge)) and the flow-in current from the corotron charger into the developing roller. The following description shows an absolute value of the applied voltage to neutralizing charger 9 and an absolute value of the flow-in current into developing roller 4. The same thing may hold true for the drawings.

As illustrated in FIG. 3, static charger 6 and neutralizing charger 9 are equal to each other in a configuration and a length to developing roller 4. In this case, typically, a charger applied with negative voltage rather than positive voltage (i.e., neutralizing charger 9) tends to be discharged. FIG. 3 illustrates dimensional examples of L1=16 mm, L2=16 mm, L3=10 mm, and L4=7 mm. In FIG. 3, L4 denotes a length from the center of wire 22 to a surface, which is in closest proximity to the center of wire 22, of developing roller 4.

As illustrated in FIG. 4, hence, in a case where the applied voltage to static charger 6 is equal to the applied voltage to neutralizing charger 9, the flow-in current from neutralizing charger 9 into developing roller 4 is larger than the flow-in current from static charger 6 into developing roller 4. In FIG. 4, the horizontal axis indicates the applied voltage to wire 22, and the longitudinal axis indicates the flow-in current into developing roller 4. A current value in the longitudinal axis is obtained by dividing the flow-in current into developing roller 4 by a length of an area where the current is flown, and then normalizing the resultant into current per unit length. The same thing may hold true for the figures illustrating a voltage-current characteristic.

In the case of applying negative voltage, a discharge unstable region exists until discharge initiation voltage reaches a certain level. The unstable discharge refers to a state of a charger having an even discharge area and an uneven discharge area depending on a location of a wire. Accordingly, the applied voltage to the charger preferably exceeds the discharge unstable region in order that the charger is stably discharged. In the example illustrated in FIG. 4, the applied voltage is preferably not less than 4.5 kV.

On the other hand, excessively high applied voltage causes leakage from wire 22 and casing 21 irrespective of positive discharge and negative discharge. In the example illustrated in FIG. 4, the applied voltage of 6.5 kV causes leakage. The applied voltage preferably has an upper limit of 6.0 kV in view of safety. Accordingly, the applied voltage to wire 22 has an appropriate range. The lower limit of the appropriate range in the case of negative discharge is higher than the lower limit of the appropriate range in the case of positive discharge because of the existence of the discharge unstable region.

In wet-type developing device 100, preferably, a toner charged level at development portion n1 is high in view of image quality. However, an excessively high toner charged level degrades developing efficiency and lowers image density. Therefore, the toner charged level also has an appropriate range for improving the developing efficiency and increasing the image density. The toner charged level is determined from the flow-in current from static charger 6 into developing roller 4. Therefore, the amount of flow-in current also has an appropriate range.

In a case of using a sheet of paper with large surface roughness, it is necessary to increase an amount of toner particles on developing roller 4. In this case, it is also necessary to increase the amount of flow-in current from static charger 6 into developing roller 4 in order to keep the toner charged level constant. Therefore, it is necessary to change the amount of flow-in current from static charger 6 into developing roller 4, depending on a kind of a sheet of paper to be used.

On the other hand, the toner charged level before cleaning blade 10 performs the cleaning process is advantageously low for the cleaning process because of the following reason. That is, when the toner charged level is low, electrostatic adhesion of the toner particles to developing roller 4 becomes small, so that cleaning blade 10 can easily scrape the toner off developing roller 4. For this reason, neutralizing charger 9 lowers the toner charged level by applying, to the toner particles, electric charge which is opposite in polarity to the electric charged applied to the toner particles.

If neutralizing charger 9 applies the electric charge in a small amount, the toner particles are unsatisfactorily neutralized. On the other hand, if neutralizing charger 9 applies the electric charge in a large amount, the toner particles are charged with reverse polarity, and therefore cannot be appropriately neutralized. In addition, the flow-in current from neutralizing charger 9 into developing roller 4 also has an appropriate range which depends on the toner charged level and the amount of toner particles on developing roller 4. The cleaning process ends in failure if the flow-in current from neutralizing charger 9 into developing roller 4 deviates from the appropriate range.

Further, if the applied voltage to neutralizing charger 9 is low and falls within the discharge unstable region, neutralizing charger 9 has areas which are different from one another in an amount of flow-in current into developing roller 4, in the axial direction of wire 22. Consequently, the cleaning process ends in failure.

The toner charged level is lowered with a lapse of time from the start of static charge. Therefore, it is known that the cleaning performance is improved in such a manner that the flow-in current from neutralizing charger 9 into developing roller 4 is reduced to about a half of the flow-in current from static charger 6 into developing roller 4. Accordingly, it is apparent from FIG. 4 that the appropriate flown-in current from neutralizing charger 9 is 0.2 mA/m and the applied voltage to neutralizing charger 9 is 4.3 kV at this time in a case where the target current from static charger 6 is 0.4 mA/m. However, the applied voltage of 4.3 kV falls within the discharge unstable region, so that neutralizing charger 9 is unevenly discharged in the axial direction. Consequently, the cleaning process ends in failure.

Figure 5:
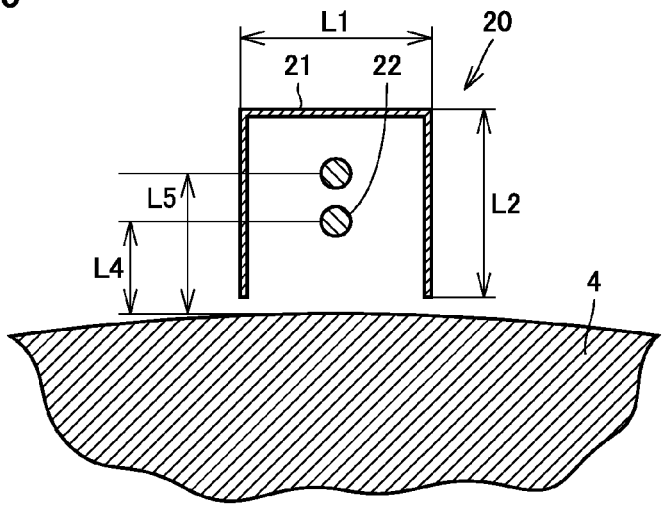
FIG. 5 illustrates a sectional structure of the corotron charger, in the first embodiment.
Figure 6:
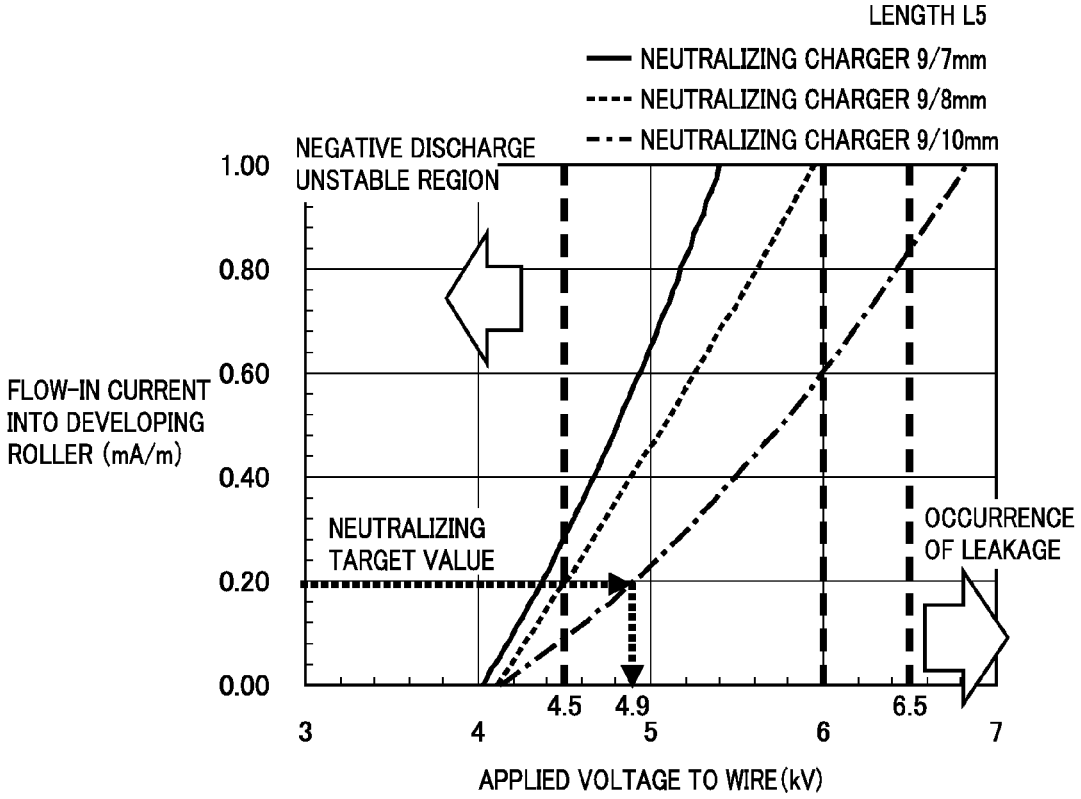
FIG. 6 illustrates a voltage-current characteristic indicating a relation between the applied voltage to the wire of the corotron charger and the flow-in current from the corotron charger into the developing roller in a case where the wire is brought apart from the developing roller, in the first embodiment.

It order to improve the cleaning performance, wire 22 is brought apart from developing roller 4 as illustrated in FIG. 5. In the first embodiment, the length from casing 21 to developing roller 4 is not changed, but wire 22 is brought apart from developing roller 4. As illustrated in FIG. 6, this configuration decreases the flow-in current into developing roller 4 even in the case where the same voltage is applied to wire 22.

FIG. 6 illustrates a case of L5=8 mm as to the length from wire 22 to developing roller 4, that is, a case where the location of wire 22 is changed by 1 mm from the case of L4=7 mm illustrated in FIG. 3. The applied voltage for attaining the appropriate flow-in current of 0.2 mA/m from neutralizing charger 9 is 4.5 kV. This applied voltage exceeds the discharge unstable region, so that neutralizing charger 9 is stably discharged. Thus, the cleaning performance is improved.

In a case of L5=10 mm, further, the applied voltage for attaining the appropriate flow-in current of 0.2 mA/m from neutralizing charger 9 is 4.9 kV, so that neutralizing charger 9 is further stably discharged. In the case of L5=10 mm, however, when the applied voltage is 4.5 kV, the flow-in current into developing roller 4 is 0.08 mA. At this time, the appropriate flow-in current from static charger 6 into developing roller 4 is 0.16 mA. Thus, the usable range of the current from static charger 6 is extended.

It is apparent from the foregoing description that the applied voltage for attaining the same flow-in current becomes high in such a manner that the characteristic of the flow-in current from neutralizing charger 9 into developing roller 4 is made lower than the characteristic of the flow-in current from neutralizing charger 9 having the same configuration as that of static charger 6 (i.e., the flow-in current into developing roller 4 in the case of the same applied voltage is decreased). As a result, it is possible to use neutralizing charger 9 in the discharge stable region. Moreover, it is possible to use neutralizing charger 9 in the region where the cleaning process is successfully performed. Further, it is possible to use neutralizing charger 9 in the small amount of flow-in current.

(Second Embodiment)

The first embodiment describes the flow-in current from neutralizing charger 9 into developing roller 4 in wet-type developing device 100 of wet-type image forming apparatus 1000. A second embodiment describes a correlation between the flow-in current from neutralizing charger 9 into developing roller 4 and the flow-in current from static charger 6 into developing roller 4. That is, the second embodiment describes an allowable range of settings for static charger 6 and neutralizing charger 9.

An allowable width of the settings for static charger 6 and neutralizing charger 9 is determined from the critical limit (voltage lower limit) of discharge stability (occurrence of uneven neutralization), and the occurrence of leakage (voltage upper limit), regarding neutralizing charger 9 in the first embodiment. In addition, the allowable width is also determined from an appropriate value of neutralizing charger 9 for static charger 6 (the flow-in current from neutralizing charger 9 is preferably about a half of the flow-in current from static charger 6).

Specifically, the flow-in current from neutralizing charger 9 is a half of the flow-in current from static charger 6. Moreover, the lower limit of applied voltage is determined from the discharge stability of neutralizing charger 9. Further, the upper limit of applied voltage is determined from the leakage from static charger 6. However, the upper limit is occasionally determined from the leakage from neutralizing charger 9, depending on the configuration of neutralizing charger 9.

These parameters vary depending on the configurations of static charger 6 and neutralizing charger 9. With reference to FIGS. 7 and 8, next, description will be given of a relation between the configuration and the allowable width.

FIG. 7 illustrates a voltage-current characteristic indicating a relation between the applied voltage to wire 22 and the flow-in current into developing roller 4 in a case where static charger 6 and neutralizing charger 9 are equal in constituent elements to each other (the configuration illustrated in FIG. 5), the length from wire 22 of static charger 6 to developing roller 4 is 7 mm, and the length from wire 22 of neutralizing charger 9 to developing roller 4 is 7 mm. FIG. 8 illustrates an allowable width within which the flow-in current from static charger 6 can be set, in the case illustrated in FIG. 7.

With reference to FIG. 8, in the column of "LEAKAGE", a symbol "A" indicates that no leakage occurs, and a symbol "F" indicates that leakage occurs. Moreover, in the column of "UNEVEN NEUTRALIZATION", a symbol "A" indicates that no uneven neutralization occurs, and a symbol "F" indicates that uneven neutralization occurs. Further, in the column of "COMPATIBILITY BETWEEN STATIC CHARGE AND NEUTRALIZATION", a symbol "A" indicates that the compatibility is established, and a symbol "F" indicates that the compatibility is not established. The same thing may hold true for FIGS. 10, 12, 14, 16, 18, 20, and 22.

As illustrated in FIG. 7, neutralizing charger 9 is stably discharged at the applied voltage of 4.5 kV, and the flow-in current from neutralizing charger 9 is 0.26 mA at this time. Therefore, neutralizing charger 9 is required to be used in a width exceeding 0.26 mA. The appropriate flow-in current from static charger 6 is 0.52 mA (current lower limit) at this time. In view of the leakage, the upper limit of the applied voltage to static charger 6 is 6 kV, and the flow-in current from static charger 6 is 0.8 mA (current upper limit) at this time. As illustrated in FIG. 8, the current range which allows the compatible use of static charger 6 and neutralizing charger 9 is 0.52 to 0.8 mA, and the settable width is 0.28 mA.

FIG. 9 illustrates a voltage-current characteristic indicating a relation between the applied voltage to the wire and the flow-in current into the developing roller in a case where the length from wire 22 of static charger 6 to developing roller 4 is maintained at 7 mm whereas the length from wire 22 of neutralizing charger 9 to developing roller 4 is changed to 8 mm. FIG. 10 illustrates an allowable width within which the flow-in current from static charger 6 can be set, in the case illustrated in FIG. 9.

As illustrated in FIG. 9, the flow-in current from neutralizing charger 9 into developing roller 4 is decreased. As a result, neutralizing charger 9 is stably discharged at the applied voltage of 4.5 kV, and the flow-in current from neutralizing charger 9 is 0.20 mA at this time. The appropriate flow-in current from static charger 6 is 0.40 mA at this time. The upper limit of the flow-in current from static charger 6 is 0.8 mA which is equal to that illustrated in FIG. 7. As illustrated in FIG. 10, therefore, the settable width of the flow-in current from static charger 6 is 0.4 mA.

FIGS. 11 and 12 each illustrate a case of L5=10 mm as to the length from wire 22 of neutralizing charger 9 to developing roller 4. FIGS. 13 and 14 each illustrate a case of L5=12 mm as to the length from wire 22 of neutralizing charger 9 to developing roller 4. As the length from wire 22 to developing roller 4 is long, the flow-in current from neutralizing charger 9 is decreased, so that the lower limit of the current from static charger 6 is also lowered.

With reference to FIGS. 11 and 12, in the case of L5=10 mm as to the length from wire 22 of neutralizing charger 9 to developing roller 4, the lower limit of the flow-in current from static charger 6 into developing roller 4 is 0.16 mA. As a result, the settable width of the flow-in current from static charger 6 is 0.64 mA.

With reference to FIGS. 13 and 14, in the case of L5=12 mm as to the length from wire 22 of neutralizing charger 9 to developing roller 4, the lower limit of the flow-in current from static charger 6 into developing roller 4 is 0.04 mA. As a result, the settable width of the flow-in current from static charger 6 is 0.76 mA.

With reference to FIGS. 15 and 16, description will be given of a case of L5=14 mm as to the length from wire 22 of neutralizing charger 9 to developing roller 4. If the length from wire 22 of neutralizing charger 9 to developing roller 4 is too long, the flow-in current from neutralizing charger 9 into developing roller 4 is excessively decreased. Specifically, the flow-in current is 0.2 mA at most even when the applied voltage is 6 kV. Accordingly, the upper limit of the flow-in current from static charger 6 is 0.4 mA, and the settable width of the flow-in current from the static charger 6 is narrowed to 0.36 mA.

FIGS. 17 and 18 each illustrate the same case as that illustrated in FIGS. 7 and 8 except for the location of wire 22 of static charger 6. FIG. 17 illustrates a voltage-current characteristic indicating a relation between the applied voltage to the wire and the flow-in current into the developing roller in a case where the length from wire 22 of static charger 6 to developing roller 4 is 6 mm, and the length from wire 22 of neutralizing charger 9 to developing roller 4 is 7 mm. FIG. 18 illustrates an allowable width within which the flow-in current from the static charger can be set, in the case illustrated in FIG. 17.

The location of wire 22 of neutralizing charger 9 is equal to that in the case illustrated in FIG. 7, so that the lower limit of the flow-in current into developing roller 4 is 0.26 mA, and the flow-in current from static charger 6 is 0.52 mA. On the other hand, since the flow-in current from static charger 6 is increased, the flow-in current is 1.2 mA at the time when the upper limit of the applied voltage is 6 kV. As a result, the settable width of the flow-in current from static charger 6 is 0.68 mA.

FIGS. 19 and 20 each illustrate the same case as that illustrated in FIGS. 9 and 10 except for the location of wire 22 of static charger 6. FIG. 19 illustrates a voltage-current characteristic indicating a relation between the applied voltage to the wire and the flow-in current into the developing roller in a case where the length from wire 22 of static charger 6 to developing roller 4 is 6 mm, and the length from wire 22 of neutralizing charger 9 to developing roller 4 is 8 mm. FIG. 20 illustrates an allowable width within which the flow-in current from the static charger can be set, in the case illustrated in FIG. 19.

The location of wire 22 of neutralizing charger 9 is equal to that in the case illustrated in FIG. 9, so that the lower limit of the flow-in current into developing roller 4 is 0.2 mA, and the flow-in current from static charger 6 is 0.42 mA. On the other hand, since the flow-in current from static charger 6 is increased, the flow-in current is 1.2 mA at the time when the upper limit of the applied voltage is 6 kV. As a result, the settable width of the flow-in current from static charger 6 is 0.8 mA.

FIGS. 21 and 22 each illustrate the same case as that illustrated in FIGS. 13 and 14 except for the location of wire 22 of static charger 6. FIG. 21 illustrates a voltage-current characteristic indicating a relation between the applied voltage to the wire and the flow-in current into the developing roller in a case where the length from wire 22 of static charger 6 to developing roller 4 is 6 mm, and the length from wire 22 of neutralizing charger 9 to developing roller 4 is 12 mm. FIG. 22 illustrates an allowable width within which the flow-in current from the static charger can be set, in the case illustrated in FIG. 21.

The location of wire 22 of neutralizing charger 9 is equal to that in the case illustrated in FIG. 13, so that the lower limit of the flow-in current into developing roller 4 is 0.02 mA, and the flow-in current from static charger 6 is 0.04 mA. However, the flow-in current from neutralizing charger 9 into developing roller 4 is decreased. Specifically, the flow-in current is 0.4 mA at most even when the applied voltage is 6 kV. As a result, the upper limit of the flow-in current from static charger 6 into developing roller 4 is 0.8 mA. Accordingly, the settable width of the flow-in current from static charger 6 is 0.76 mA.

As is clear from the foregoing description, the settable width of the flow-in current from static charger 6 is extended in such a manner that the characteristic of the flow-in current from neutralizing charger 9 into developing roller 4 is made lower than the characteristic of the flow-in current from static charger 6 into developing roller 4 (the flow-in current at the time of the same voltage is decreased), irrespective of the configuration of static charger 6. That is, it is possible to extend the settable range of the toner charged level on developing roller 4 and the settable range of the amount of toner adhering to developing roller 4.

However, if the characteristic of the flow-in current from neutralizing charger 9 into developing roller 4 is too low, the applied voltage becomes too high, so that the settable width of the flow-in current from the static charger 6 is narrowed. Accordingly, the flow-in current from neutralizing charger 9 into developing roller 4 is preferably not less than a half of the flow-in current from static charger 6 into developing roller 4.

Figure 23:
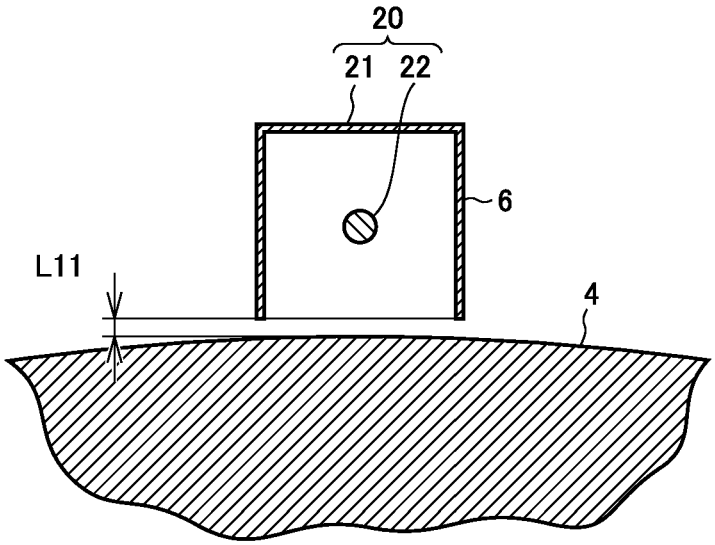
FIG. 23 illustrates a sectional structure in a case where a length from a casing of the static charger to the developing roller is L11, in one modification of the second embodiment.
Figure 24:
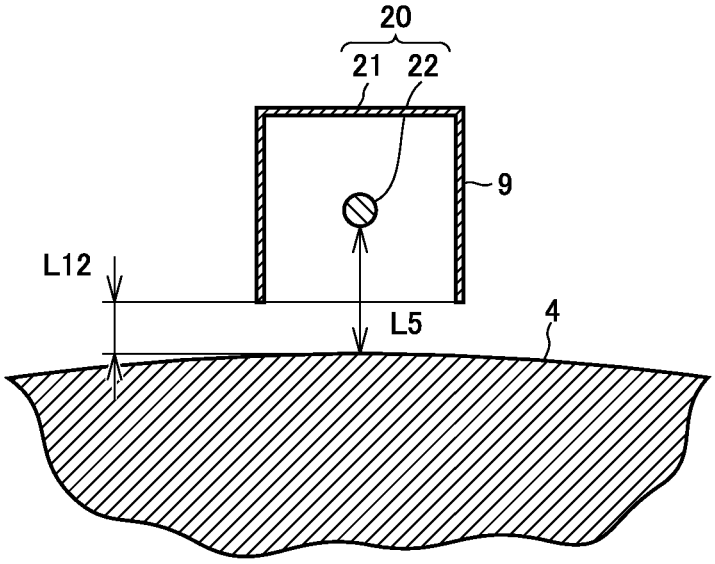
FIG. 24 illustrates a sectional structure in a case where a length from a casing of the neutralizing charger to the developing roller is L12 (L11<L12), in another modification of the second embodiment.

In the second embodiment, the location of casing 21 relative to developing roller 4 is not changed, but the length from wire 22 to developing roller 4 is changed for controlling the relation between the current characteristic of static charger 6 and the current characteristic of neutralizing charger 9. Alternatively, with regard to the configuration of static charger 6 illustrated in FIG. 23 (the length from casing 21 to developing roller 4 is L11), as in a configuration of neutralizing charger 9 illustrated in FIG. 24 (the length from casing 21 to developing roller 4 is L12), the length from casing 21 to developing roller 4 may be changed from L11 (FIG. 23) to L12 (FIG. 24) so as to change length L5 from wire 22 to developing roller 4 on the condition that corotron chargers 20 are equal in constituent elements to each other.

The length from casing 21 to developing roller 4 refers to a length from a portion, which is in closest proximity to developing roller 4, of casing 21 to a portion, which is in closest proximity to casing 21, of developing roller 4. The same thing may hold true for the following description.

Figure 25:
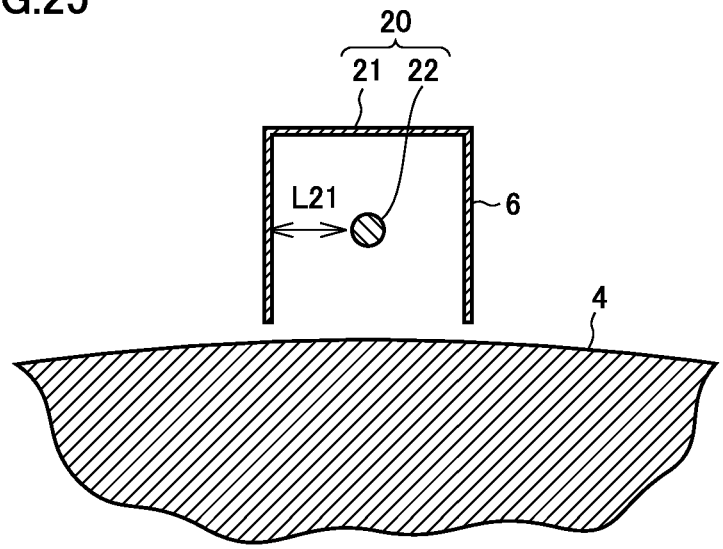
FIG. 25 illustrates a sectional structure in a case where a length of a portion between the casing and the wire which are in closest proximity to each other in the static charger is L21, in still another modification of the second embodiment.
Figure 26:
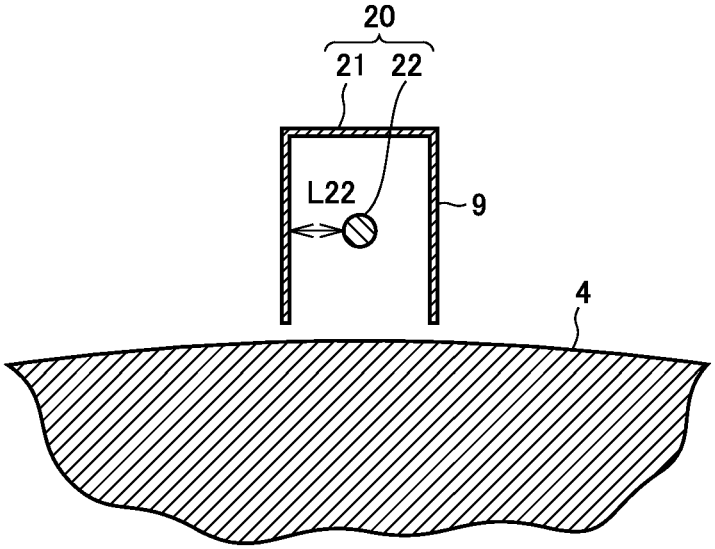
FIG. 26 illustrates a sectional structure in a case where a length of a portion between the casing and the wire which are in closest proximity to each other in the neutralizing charger is L22 (L21>L22), in yet another modification of the second embodiment.

Alternatively, with regard to a configuration of static charger 6 illustrated in FIG. 25 (a length of a portion between casing 21 and wire 22 which are in closest proximity to each other is L21), as in a configuration of neutralizing charger 9 illustrated in FIG. 26 (a length of a portion between casing 21 and wire 22 which are in closest proximity to each other is L22: L21>L22), the length of the portion between casing 21 and wire 22 which are in closest proximity to each other may be changed from L21 (FIG. 25) to L22 (FIG. 26) on the condition that corotron chargers 20 are equal in constituent elements to each other.

As described above, it is possible to control the flow-in current from neutralizing charger 9 into developing roller 4 by narrowing the width of casing 21 of neutralizing charger 9 so as to shorten the length between wire 22 and casing 21. As a result, it is possible to control the relation between the current characteristic of static charger 6 and the current characteristic of neutralizing charger 9.

Figure 27:
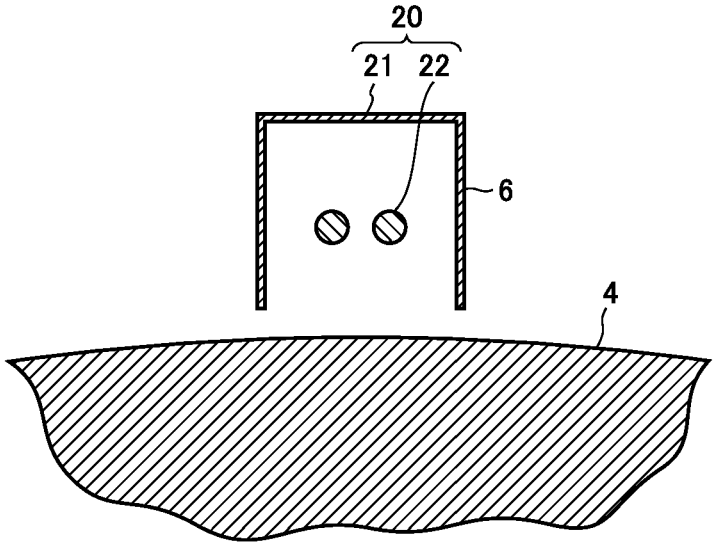
FIG. 27 illustrates a sectional structure in a case where the number of wires in the static charger is two, in yet another modification of the second embodiment.
Figure 28:
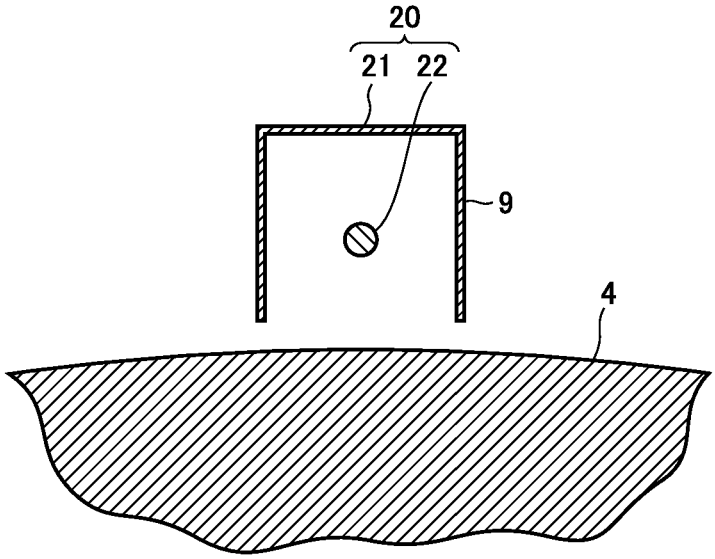
FIG. 28 illustrates a sectional structure in a case where the number of wires in the neutralizing charger is one, in yet another modification of the second embodiment.

Alternatively, with regard to a configuration of static charger 6 illustrated in FIG. 27 (the number of wires 22 is two), as in a configuration of neutralizing charger 9 illustrated in FIG. 28 (the number of wires 22 is one), the flow-in current from neutralizing charger 9 into developing roller 4 can be controlled in such a manner that static charger 6 and neutralizing charger 9 are made different from each other in number of wires. As a result, it is possible to control the relation between the current characteristic of static charger 6 and the current characteristic of neutralizing charger 9.

Furthermore, the configurations described above may be combined with one another.

(Third Embodiment)

Figure 29:
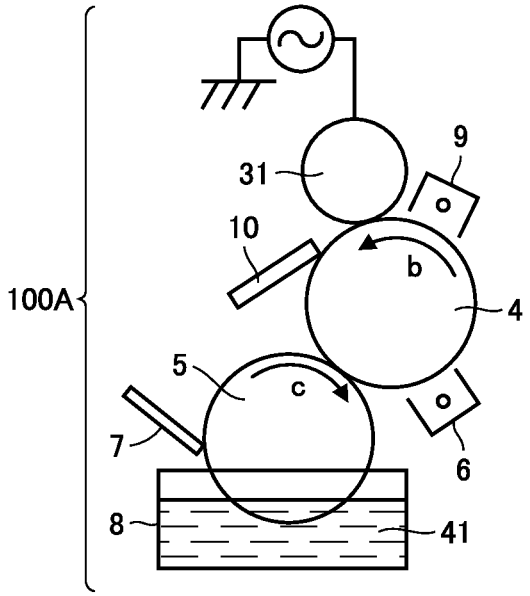
FIG. 29 schematically illustrates a configuration of a wet-type developing device, in a third embodiment.

With reference to FIG. 29, description will be given of a configuration of a wet-type developing device 100A in a third embodiment. FIG. 29 schematically illustrates the configuration of wet-type developing device 100A, in the third embodiment. Wet-type developing device 100A is basically equal in configuration to wet-type developing device 100. Wet-type developing device 100A includes a roller 31 disposed between a neutralizing charger 9 and a cleaning blade 10 and configured to apply AC bias to a layer of a liquid developer 41 on a developing roller 4. Roller 31 has a function as a toner particle dispersing member.

Roller 31 serving as a toner particle dispersing member disperses toner particles in liquid developer 41, so that the toner particles are separated from a surface of developing roller 4. Therefore, it is possible to further improve the cleaning performance. In the third embodiment, the effect of AC bias from roller 31 for separating the toner particles from developing roller 4 is enhanced by the stabilization of neutralization by neutralizing charger 9. Therefore, it is possible to improve the cleaning performance. In the third embodiment, moreover, the toner particles are dispersed in the layer of liquid developer 41. Therefore, it is possible to suppress the deposition of the toner particles on a wedge portion (blade edge) formed by cleaning blade 10 and developing roller 4.

As described above, according to the wet-type developing device and the wet-type image forming apparatus in each of the foregoing embodiments, the discharge characteristic of the neutralizing charger is made lower than the discharge characteristic of the static charger. Thus, the neutralizing charger is applied with high voltage and is stably discharged. Therefore, it is possible to extend the settable range of the flow-in current into the developing roller while suppressing generation of noise on an image due to leakage from the static charger and occurrence of failed cleaning at the cleaning portion.

As a result, it is possible to suppress generation of noise on an image due to leakage from the neutralizing charger, and to suppress occurrence of failed cleaning, which appears as a streak, due to uneven discharge by the neutralizing charger. In addition, it is also possible to suppress local deposition of the liquid developer due to the uneven discharge by the neutralizing charger.

Moreover, the voltage-current (V-I) characteristic of neutralizing charger 9 (negative discharge) is made lower than the voltage-current (V-I) characteristic (absolute value) of neutralizing charger 9 which is equal in constituent elements to static charger 6 (positive discharge). Thus, neutralizing charger 9 is applied with high voltage, and is negatively discharged in a stable manner. Therefore, it is possible to suppress failed cleaning.

Moreover, the voltage-current (V-I) characteristic of static charger 6 (positive discharge) is made higher than the voltage-current (V-I) characteristic (absolute value) of neutralizing charger 9 (negative discharge). Thus, neutralizing charger 9 is applied with high voltage, and is negatively discharged in a stable manner. Therefore, it is possible to suppress failed cleaning. Further, static charger 6 is applied with low voltage which is lower than leakage voltage, and is stably discharged. Therefore, it is possible to suppress generation of noise on an image. Furthermore, the flow-in current into developing roller 4 is set within the wider width. Therefore, it is possible to extend a controllable width of a toner charged level, a usable width of a sheet of paper, and an adjustable width of image density.

Roller 31 serving as a toner particle dispersing member is disposed between cleaning blade 10 and neutralizing charger 9. Moreover, the voltage-current (V-I) characteristic of static charger 6 (positive discharge) is made higher than the voltage-current (V-I) characteristic (absolute value) of neutralizing charger 9 (negative discharge). Thus, the toner particles subjected to the neutralization by neutralizing charger 9 are once removed from the surface of developing roller 4 and then are dispersed by roller 31. Therefore, it is possible to further improve the cleaning performance. Further, it is possible to suppress deposition of the toner particles on the wedge portion (blade edge) formed by cleaning blade 10 and developing roller 4.

The length from corotron charger 20 to developing roller 4 is changed for controlling the voltage-current (V-I) characteristics of static charger 6 and neutralizing charger 9. Therefore, it is possible to use corotron chargers 20 which are equal in configuration to each other, as static charger 6 and neutralizing charger 9. Thus, it is possible to keep costs low.

Moreover, the length between wire 22 and casing 21 is changed or the number of wires 22 is changed for controlling the voltage-current (V-I) characteristics of static charger 6 and neutralizing charger 9. Therefore, it is possible to easily increase the flow-in current from static charger 6. Thus, it is possible to address accelerated wet-type development and a large amount of adhered toner particles.

In the embodiments described above, the corotron charger is used as the static charger serving as a charging unit and the neutralizing charger serving as a neutralizing unit; however, the present invention is not limited thereto. For example, known methods such as a charging roller may be employed as long as static charge or neutralization can be realized using discharge.

In this case, the charging unit and the neutralizing unit are made different from each other in parameters, such as a length to the developing roller, a shape, and a size, which exert an influence on the voltage-current characteristic and concern device configurations other than electrical configurations. Thus, the absolute value of the voltage-current characteristic of the neutralizing unit may be made lower than the absolute value of the voltage-current characteristic of the neutralizing unit which is equal in constituent elements to the charging unit. Alternatively, the absolute value of the current from the neutralizing unit may be made smaller than the absolute value of the current from the charging unit in the case where the applied voltage to the charging unit is equal to the applied voltage to the neutralizing unit.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type developing device that employs a developer including a carrier liquid and a toner particle dispersed in the carrier liquid, the wet-type developing device comprising:

a developer carrier configured to develop an electrostatic latent image;

a charging unit configured to charge said developer on said developer carrier by discharge;

a neutralizing unit configured to neutralize electric charge of said developer after the development by discharge which is equal in manner to the discharge by said charging unit; and a cleaning member configured to remove said developer after the neutralization from said developer carrier, wherein said charging unit is applied with positive voltage, said neutralizing unit is applied with negative voltage, and said charging unit and said neutralizing unit are made different from each other in one of a sectional configuration and a length to said developer carrier such that an absolute value of a voltage-current characteristic of said neutralizing unit becomes smaller than an absolute value of a voltage-current characteristic of said neutralizing unit including a constituent element equal to a constituent element of said charging unit, the voltage-current characteristic indicating a relation between an applied voltage and a current flowing into the developer carrier.

2. The wet-type developing device according to claim 1, wherein said charging unit is formed of a corotron charger, and said neutralizing unit is formed of a corotron charger.

3. The wet-type developing device according to claim 2, wherein each of said corotron chargers includes a wire and a casing configured to cover said wire, and a length from said casing of said charging unit to said developer carrier is longer than a length from said casing of said neutralizing unit to said developer carrier.

4. The wet-type developing device according to claim 2, wherein each of said corotron chargers includes a wire and a casing configured to cover said wire, and a length of a portion between said wire and said casing which are in closest proximity to each other in said charging unit is longer than a length of a portion between said wire and said casing which are in closest proximity to each other in said neutralizing unit.

5. The wet-type developing device according to claim 2, wherein each of said corotron chargers includes a wire and a casing configured to cover said wire, and the number of wires in said charging unit is larger than the number of wires in said neutralizing unit.

6. The wet-type developing device according to claim 2, further comprising:

a toner particle dispersing member disposed on a downstream side of said neutralizing unit and an upstream side of said cleaning member in a direction of rotation of said developer carrier so as to face said developer carrier.

7. The wet-type developing device according to claim 6, wherein said toner particle dispersing member is in contact with said developer carrier, and applies AC bias to said developer carrier.

8. A wet-type image forming apparatus comprising:

an image carrier;

an image forming mechanism configured to form an electrostatic latent image on said image carrier; and the wet-type developing device according to claim 1 configured to develop said electrostatic latent image formed on said image carrier by said image forming mechanism.

9. A wet-type developing device that employs a developer including a carrier liquid and a toner particle dispersed in the carrier liquid, the wet-type developing device comprising:

a developer carrier configured to develop an electrostatic latent image;

a charging unit configured to charge said developer on said developer carrier by discharge;

a neutralizing unit configured to neutralize electric charge of said developer after the development by discharge which is equal in manner to the discharge by said charging unit; and a cleaning member configured to remove said developer after the neutralization from said developer carrier, wherein said charging unit is applied with positive voltage, said neutralizing unit is applied with negative voltage, and said charging unit and said neutralizing unit are made different from each other in one of a sectional configuration and a length to said developer carrier such that an absolute value of a voltage-current characteristic of said neutralizing unit becomes smaller than an absolute value of a voltage-current characteristic of said neutralizing unit including a constituent element equal to a constituent element of said charging unit, wherein said charging unit is formed of a corotron charger, said neutralizing unit is formed of a corotron charger, and said charging unit and said neutralizing unit are made different from each other in the sectional configuration of said corotron charger such that, with regard to voltage-current characteristics of said corotron chargers, an absolute value of current from said neutralizing unit becomes not less than about a half of an absolute value of current from said charging unit in a case where applied voltage to said charging unit is equal to applied voltage to said neutralizing unit.

10. A wet-type developing device that employs a developer including a carrier liquid and a toner particle dispersed in the carrier liquid, the wet-type developing device comprising:

a developer carrier configured to develop an electrostatic latent image;

a charging unit configured to charge said developer on said developer carrier by discharge;

a neutralizing unit configured to neutralize electric charge of said developer after the development by discharge which is equal in manner to the discharge by said charging unit; and a cleaning member configured to remove said developer after the neutralization from said developer carrier, wherein said charging unit is applied with positive voltage, said neutralizing unit is applied with negative voltage, and said charging unit and said neutralizing unit are made different from each other in one of a sectional configuration and a length to said developer carrier such that an absolute value of a voltage-current characteristic of said neutralizing unit becomes smaller than an absolute value of a voltage-current characteristic of said neutralizing unit including a constituent element equal to a constituent element of said charging unit, wherein said charging unit is formed of a corotron charger, said neutralizing unit is formed of a corotron charger, each of said corotron chargers includes, as the constituent element, a wire and a casing configured to cover said wire, and a length from said wire of said neutralizing unit to said developer carrier is longer than a length from said wire of said charging unit to said developer carrier.

11. A wet-type developing device that employs a developer including a carrier liquid and a toner particle dispersed in the carrier liquid, the wet-type developing device comprising:

a developer carrier configured to develop an electrostatic latent image;

a charging unit configured to charge said developer on said developer carrier by discharge;

a neutralizing unit configured to neutralize electric charge of said developer after the development by discharge which is equal in manner to the discharge by said charging unit; and a cleaning member configured to remove said developer after the neutralization from said developer carrier, wherein said charging unit is applied with positive voltage, said neutralizing unit is applied with negative voltage, and said charging unit and said neutralizing unit are made different from each other in one of a sectional configuration and a length to said developer carrier such that, with regard to voltage-current characteristics of said charging unit and neutralizing unit, an absolute value of current from said neutralizing unit becomes smaller than an absolute value of current from said charging unit in a case where applied voltage to said charging unit is equal to applied voltage to said neutralizing unit, the voltage-current characteristic indicating a relation between an applied voltage and a current flowing into the developer carrier.

12. The wet-type developing device according to claim 11, wherein said charging unit is formed of a corotron charger, and said neutralizing unit is formed of a corotron charger.

13. The wet-type developing device according to claim 12, wherein each of said corotron chargers includes a wire and a casing configured to cover said wire, and a length from said casing of said charging unit to said developer carrier is longer than a length from said casing of said neutralizing unit to said developer carrier.

14. The wet-type developing device according to claim 12, wherein each of said corotron chargers includes a wire and a casing configured to cover said wire, and a length of a portion between said wire and said casing which are in closest proximity to each other in said charging unit is longer than a length of a portion between said wire and said casing which are in closest proximity to each other in said neutralizing unit.

15. The wet-type developing device according to claim 12, wherein each of said corotron chargers includes a wire and a casing configured to cover said wire, and the number of wires in said charging unit is larger than the number of wires in said neutralizing unit.

16. The wet-type developing device according to claim 11, further comprising:

a toner particle dispersing member disposed on a downstream side of said neutralizing unit and an upstream side of said cleaning member in a direction of rotation of said developer carrier so as to face said developer carrier.

17. The wet-type developing device according to claim 16, wherein said toner particle dispersing member is in contact with said developer carrier, and applies AC bias to said developer carrier.

18. A wet-type image forming apparatus comprising:

an image carrier;

an image forming mechanism configured to form an electrostatic latent image on said image carrier; and the wet-type developing device according to claim 11 configured to develop said electrostatic latent image formed on said image carrier by said image forming mechanism.

19. A wet-type developing device that employs a developer including a carrier liquid and a toner particle dispersed in the carrier liquid, the wet-type developing device comprising:

a developer carrier configured to develop an electrostatic latent image;

a charging unit configured to charge said developer on said developer carrier by discharge;

a neutralizing unit configured to neutralize electric charge of said developer after the development by discharge which is equal in manner to the discharge by said charging unit; and a cleaning member configured to remove said developer after the neutralization from said developer carrier, wherein said charging unit is applied with positive voltage, said neutralizing unit is applied with negative voltage, and said charging unit and said neutralizing unit are made different from each other in one of a sectional configuration and a length to said developer carrier such that, with regard to voltage-current characteristics of said charging unit and neutralizing unit, an absolute value of current from said neutralizing unit becomes smaller than an absolute value of current from said charging unit in a case where applied voltage to said charging unit is equal to applied voltage to said neutralizing unit , wherein said charging unit is formed of a corotron charger, said neutralizing unit is formed of a corotron charger, and said charging unit and said neutralizing unit are made different from each other in the sectional configuration of said corotron charger such that, with regard to voltage-current characteristics of said corotron chargers, an absolute value of current from said neutralizing unit becomes not less than about a half of an absolute value of current from said charging unit in a case where applied voltage to said charging unit is equal to applied voltage to said neutralizing unit.

20. A wet-type developing device that employs a developer including a carrier liquid and a toner particle dispersed in the carrier liquid, the wet-type developing device comprising:

a developer carrier configured to develop an electrostatic latent image;

a charging unit configured to charge said developer on said developer carrier by discharge;

a neutralizing unit configured to neutralize electric charge of said developer after the development by discharge which is equal in manner to the discharge by said charging unit; and a cleaning member configured to remove said developer after the neutralization from said developer carrier, wherein said charging unit is applied with positive voltage, said neutralizing unit is applied with negative voltage, and said charging unit and said neutralizing unit are made different from each other in one of a sectional configuration and a length to said developer carrier such that, with regard to voltage-current characteristics of said charging unit and neutralizing unit, an absolute value of current from said neutralizing unit becomes smaller than an absolute value of current from said charging unit in a case where applied voltage to said charging unit is equal to applied voltage to said neutralizing unit , wherein said charging unit is formed of a corotron charger, said neutralizing unit is formed of a corotron charger, each of said corotron chargers includes, as the constituent element, a wire and a casing configured to cover said wire, and a length from said wire of said neutralizing unit to said developer carrier is longer than a length from said wire of said charging unit to said developer carrier.

* * * * *